US012649890B2

(12) United States Patent
Matsuyama et al.

(10) Patent No.: US 12,649,890 B2
(45) Date of Patent: Jun. 9, 2026

(54) RAW MATERIAL OF GREASE, METHOD FOR PRODUCING RAW MATERIAL OF GREASE, METHOD FOR PRODUCING GREASE, AND GREASE

(71) Applicant: JTEKT CORPORATION, Kariya (JP)

(72) Inventors: Junya Matsuyama, Kariya (JP); Kanako Niiya, Kariya (JP); Takeshi Yamamoto, Kariya (JP)

(73) Assignee: JTEKT CORPORATION, Kariya (JP)

( * ) Notice: Subject to any disclaimer, the term of this patent is extended or adjusted under 35 U.S.C. 154(b) by 512 days.

(21) Appl. No.: 18/013,485

(22) PCT Filed: Jul. 14, 2021

(86) PCT No.: PCT/JP2021/026499
§ 371 (c)(1),
(2) Date: Dec. 28, 2022

(87) PCT Pub. No.: WO2022/019198
PCT Pub. Date: Jan. 27, 2022

(65) Prior Publication Data

US 2023/0313066 A1 Oct. 5, 2023

(30) Foreign Application Priority Data

Jul. 22, 2020 (JP) ..... 2020-125473

(51) Int. Cl.
*C10M 169/02* (2006.01)
*C10M 105/36* (2006.01)
(Continued)

(52) U.S. Cl.
CPC ..... *C10M 169/02* (2013.01); *C10M 105/36* (2013.01); *C10M 107/18* (2013.01);
(Continued)

(58) Field of Classification Search
CPC ..... C10N 2040/02; C10N 2070/00; C10N 2030/08; C10N 2030/06; C10N 2020/06;
(Continued)

(56) References Cited

U.S. PATENT DOCUMENTS 3,243,372 A 3/1966 Goodrich et al.
5,301,923 A 4/1994 Asao et al.
(Continued)

FOREIGN PATENT DOCUMENTS

CN 1754901 A 4/2006
CN 101440329 A 5/2009
(Continued)

OTHER PUBLICATIONS

Oct. 5, 2021 International Search Report issued in International Patent Application No. PCT/JP2021/026499.
(Continued)

*Primary Examiner* — Vishal V Vasisth
(74) *Attorney, Agent, or Firm* — Oliff PLC

(57) ABSTRACT

A method for producing a raw material of grease, including: preparing first thickener raw material; second thickener raw material; first lubricating oil; second lubricating oil; first solvent with a boiling point lower than those of the oils, dissolves the first oil, and does not dissolve a produced thickener; and a second solvent with a boiling point lower than those of the oils, dissolves the second oil, and does not dissolve the produced thickener; dissolving the first lubricating oil in the first solvent, and dissolving or dispersing the first thickener raw material in the first solvent to obtain a first mixed solution; dissolving the second lubricating oil in the second solvent, and dissolving or dispersing the second thickener raw material in the second solvent to obtain a second mixed solution; and mixing the first and second
(Continued)

mixed solutions, and reacting the first and second thickener raw materials producing a thickener.

8 Claims, 18 Drawing Sheets

(51) Int. Cl.
*C10M 107/18* (2006.01)
*C10M 115/08* (2006.01)
*C10M 177/00* (2006.01)
*C10N 20/06* (2006.01)

(52) U.S. Cl.
CPC ..... *C10M 115/08* (2013.01); *C10M 177/00* (2013.01); *C10M 2205/0206* (2013.01); *C10M 2207/2855* (2013.01); *C10M 2215/1026* (2013.01); *C10M 2290/04* (2013.01); *C10M 2290/10* (2013.01); *C10N 2020/06* (2013.01)

(58) Field of Classification Search
CPC ..... C10N 2020/02; C10N 2040/04; C10N 2050/10; C10M 169/02; C10M 107/18; C10M 115/08; C10M 177/00; C10M 105/36; C10M 2203/065; C10M 2205/0206; C10M 2207/2855; C10M 2205/028; C10M 2209/1033; C10M 2203/1006; C10M 2215/1026; C10M 2290/04; C10M 2290/10; C10M 2205/0285
See application file for complete search history.

(56) References Cited

U.S. PATENT DOCUMENTS

| | | | |
|---|---|---|---|
| 5,314,982 | A | 5/1994 | Rasp et al. |
| 6,063,743 | A | 5/2000 | Seubert et al. |
| 2006/0052261 | A1 | 3/2006 | Kray et al. |
| 2006/0058203 | A1 | 3/2006 | Laufer et al. |
| 2006/0073989 | A1 | 4/2006 | Fujita et al. |
| 2009/0232432 | A1 | 9/2009 | Egami et al. |
| 2010/0323934 | A1 | 12/2010 | Kondo et al. |
| 2014/0228135 | A1 | 8/2014 | Kondo et al. |
| 2016/0002557 | A1 | 1/2016 | Daegling et al. |
| 2018/0079988 | A1 | 3/2018 | Inoue et al. |

FOREIGN PATENT DOCUMENTS

| | | | |
|---|---|---|---|
| DE | 10 2004 044 878 | A1 | 3/2006 |
| EP | 0274756 | A2 | 7/1988 |
| JP | S54-114506 | A | 9/1979 |
| JP | S56-93799 | A | 7/1981 |
| JP | S57-108196 | A | 7/1982 |
| JP | H05-209183 | A | 8/1993 |
| JP | H06-184577 | A | 7/1994 |
| JP | H07042740 | A | 2/1995 |
| JP | 2005-105238 | A | 4/2005 |
| JP | 2005098505 | A | 4/2005 |
| JP | 2006-070262 | A | 3/2006 |
| JP | 2006-070263 | A | 3/2006 |
| JP | 2008-163201 | A | 7/2008 |
| JP | 2014-214264 | A | 11/2014 |
| JP | 2016-506985 | A | 3/2016 |
| JP | 2016-175962 | A | 10/2016 |
| JP | 2019-081881 | A | 5/2019 |
| WO | 2007/026868 | A1 | 3/2007 |
| WO | 2007/087324 | A2 | 8/2007 |

OTHER PUBLICATIONS

Hui Xu et al. "Study On the Process of Preparing Diurea Grease With Preformed Diurea Thickener". China Academic Journal Electronic Publishing House, Dec. 2015, Issue 6, pp. 39-43.

Jun. 3, 2025 Search Report issued in European Patent Application No. 24215831.9.

Jul. 24, 2024 Extended Search Report issued in European Patent Application No. 21847065.6.

Feb. 28, 2025 English Translation of the Search Report issued in Chinese Patent Application No. 202180060725.8.

Junya Matsuyama et al.; U.S. Appl. No. 19/658,820; filed Apr. 27, 2026.

RAW MATERIAL OF GREASE, METHOD FOR PRODUCING RAW MATERIAL OF GREASE, METHOD FOR PRODUCING GREASE, AND GREASE

TECHNICAL FIELD

The present disclosure relates to a raw material of grease, a method for producing a raw material of grease, a method for producing grease, and grease.

This application is a 371 of PCT/JP2021/026499 filed Jul. 14, 2021.

This application claims priority based on Japanese Patent Application No. 2020-125473 filed on Jul. 22, 2020, the entire contents of which are incorporated herein by reference.

BACKGROUND ART

Urea-based grease is usually produced through a step of reacting an amine compound and an isocyanate compound in a base oil to synthesize a urea compound as a thickener in the base oil, and then refining thickener particles by applying shear or the like.

In this production method, unreacted substances remaining in the base oil after the reaction cannot be completely removed, and may remain in the grease.

As a method for producing urea-based grease, a method is also known in which an amine compound and an isocyanate compound are reacted in a solvent to synthesize a urea compound, then the solvent is removed to produce a powdery urea compound, and then the urea compound is mixed with a base oil (see, for example, PATENT LITERATURE 1). PATENT LITERATURE 2 and 3 disclose a (poly)urea powder that can be used for urea-based grease and a method for producing the same.

CITATION LIST

Patent Literature

PATENT LITERATURE 1: Japanese Laid-Open Patent Publication No. 2019-81881

PATENT LITERATURE 2: Japanese Laid-Open Patent Publication No. 2006-070262

PATENT LITERATURE 3: Japanese Laid-Open Patent Publication No. 2006-070263

SUMMARY OF THE INVENTION

One aspect of the present disclosure is:

a method for producing a raw material of grease, including:

preparing a first thickener raw material;

a second thickener raw material;

a first lubricating oil;

a second lubricating oil;

a first solvent that has a boiling point lower than those of the first lubricating oil and the second lubricating oil, dissolves the first lubricating oil, and does not dissolve a produced thickener; and a second solvent that has a boiling point lower than those of the first lubricating oil and the second lubricating oil, dissolves the second lubricating oil, and does not dissolve the produced thickener;

dissolving the first lubricating oil in the first solvent, and dissolving or dispersing the first thickener raw material in the first solvent to obtain a first mixed solution;

dissolving the second lubricating oil in the second solvent, and dissolving or dispersing the second thickener raw material in the second solvent to obtain a second mixed solution; and mixing the first mixed solution and the second mixed solution, and reacting the first thickener raw material and the second thickener raw material to produce a thickener.

Another aspect of the present disclosure is:

a method for producing a raw material of grease, including:

preparing a first thickener raw material;

a second thickener raw material;

a first lubricating oil;

a first solvent that has a boiling point lower than that of the first lubricating oil, dissolves the first lubricating oil, and does not dissolve a produced thickener; and a second solvent that has a boiling point lower than that of the first lubricating oil and does not dissolve a produced thickener;

dissolving the first lubricating oil in the first solvent, and dissolving or dispersing the first thickener raw material in the first solvent to obtain a first mixed solution;

dissolving or dispersing the second thickener raw material in the second solvent to obtain a second mixed solution; and mixing the first mixed solution and the second mixed solution, and reacting the first thickener raw material and the second thickener raw material to produce a thickener.

As still another aspect, the present disclosure includes a raw material of grease, a method for producing another raw material of grease, a method for producing grease, and grease.

DETAILED DESCRIPTION

Technical Problem of Present Disclosure

Figure 1:
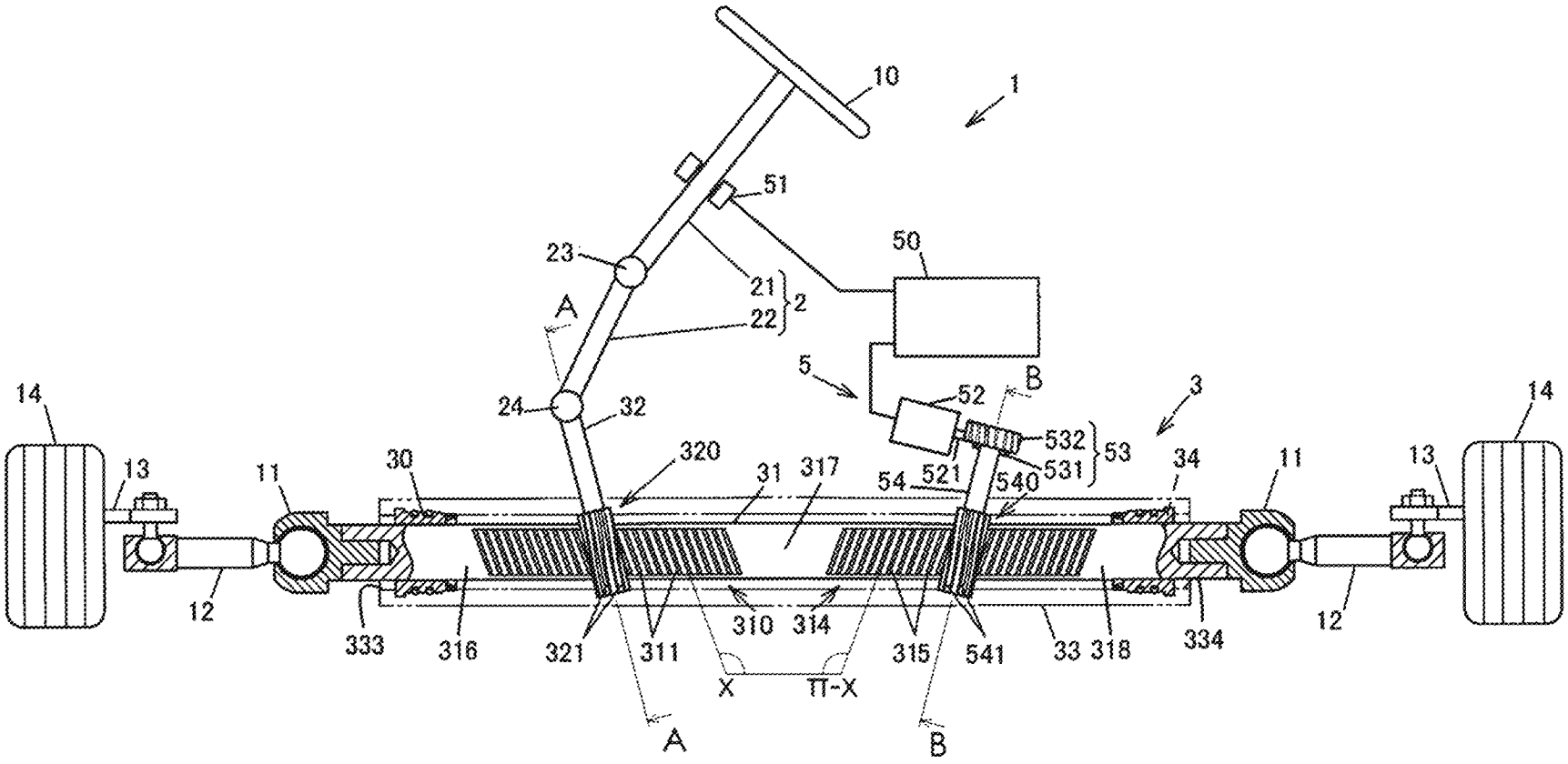
FIG. 1 is a configuration diagram schematically illustrating an example of a dual pinion electric power steering device in which grease related to the present disclosure is sealed.

A powdery urea compound synthesized in a solvent and freed of the solvent can be used as a thickener and mixed with a base oil to produce grease.

In this case, an unreacted amine compound and isocyanate compound can be removed by washing treatment before mixing with the base oil. Therefore, it is possible to prevent an unreacted amine compound and isocyanate compound from remaining in the grease.

On the other hand, when a urea compound is synthesized in a solvent and freed of the solvent, and then mixed with a base oil to produce grease, there has been a problem that the obtained grease is easily separated as compared with the grease produced by synthesizing a urea compound in a base oil, and is inferior in oil retention. One of the reasons for this has been considered that the average particle diameter of the urea compound is large.

On the other hand, in the invention described in PATENT LITERATURE 1, the particle diameter of the urea compound is controlled through a hard pulverization step using a large pulverization mill such as a jet mill and a classification step. Performing such a pulverization step or a classification step is disadvantageous in that capital investment is required.

Advantageous Effects of Invention of Present Disclosure

The raw material of grease of the present disclosure can provide grease having oil retention ensured by mixing with a base oil.

The method for producing a raw material of grease of the present disclosure can produce a raw material of grease that can provide grease containing a thickener and having oil retention ensured by mixing with a base oil.

The method for producing grease of the present disclosure can provide grease having ensured oil retention.

According to the grease of the present disclosure, it is possible to provide grease having ensured oil retention.

When such grease is used for a rolling bearing, a gear or the like, seizure resistance and wear resistance can be ensured.

Outline of Embodiment of Invention of Present Disclosure

Hereinafter, an outline of embodiments of the present disclosure will be listed and described.

The present inventors have conducted intensive studies to overcome the above problems, and completed the invention of the present disclosure.

(1) The raw material of the grease of the present disclosure includes:

a thickener;

a lubricating oil; and a solvent that has a boiling point lower than that of the lubricating oil, dissolves the lubricating oil, and does not dissolve the thickener.

The raw material of grease of the present disclosure can provide grease having oil retention ensured by mixing with a base oil.

(2) The method for producing a raw material of grease of the present disclosure includes:

preparing a first thickener raw material;

a second thickener raw material;

a first lubricating oil;

a second lubricating oil;

a first solvent that has a boiling point lower than those of the first lubricating oil and the second lubricating oil, dissolves the first lubricating oil, and does not dissolve a produced thickener; and a second solvent that has a boiling point lower than those of the first lubricating oil and the second lubricating oil, dissolves the second lubricating oil, and does not dissolve the produced thickener;

dissolving the first lubricating oil in the first solvent, and dissolving or dispersing the first thickener raw material in the first solvent to obtain a first mixed solution;

dissolving the second lubricating oil in the second solvent, and dissolving or dispersing the second thickener raw material in the second solvent to obtain a second mixed solution; and mixing the first mixed solution and the second mixed solution, and reacting the first thickener raw material and the second thickener raw material to produce a thickener.

In this case, a raw material of grease containing a thickener can be produced. The obtained raw material of grease can be mixed with a base oil to provide grease having oil retention ensured by mixing with a base oil.

(3) In the method for producing a raw material of grease according to (2), it is preferable to remove the first solvent and the second solvent after producing the thickener.

(4) In the method for producing a raw material of grease according to (2) or (3), it is preferable that at least one of the first lubricating oil and the second lubricating oil is poly-α-olefin.

(5) The method for producing a raw material of grease of the present disclosure is a method for producing a raw material of grease including:

preparing a first thickener raw material;

a second thickener raw material;

a first lubricating oil;

a first solvent that has a boiling point lower than that of the first lubricating oil, dissolves the first lubricating oil, and does not dissolve a produced thickener; and a second solvent that has a boiling point lower than that of the first lubricating oil and does not dissolve a produced thickener;

dissolving the first lubricating oil in the first solvent, and dissolving or dispersing the first thickener raw material in the first solvent to obtain a first mixed solution;

dissolving or dispersing the second thickener raw material in the second solvent to obtain a second mixed solution; and mixing the first mixed solution and the second mixed solution, and reacting the first thickener raw material and the second thickener raw material to produce a thickener.

Also in this case, a raw material of grease containing a thickener can be produced. The obtained raw material of grease can be mixed with a base oil to provide grease having oil retention ensured by mixing with a base oil.

(6) In the method for producing a raw material of grease according to (5), it is preferable to remove the first solvent and the second solvent after producing the thickener.

(7) In the method for producing a raw material of grease according to (5) or (6), it is preferable that the first lubricating oil is poly-α-olefin.

(8) Still another method for producing a raw material of grease of the present disclosure includes:

preparing a first thickener raw material;

a second thickener raw material;

a first lubricating oil;

a first solvent that has a boiling point lower than that of the first lubricating oil, and does not dissolve a produced thickener; and a second solvent that has a boiling point lower than that of the first lubricating oil and does not dissolve a produced thickener;

dissolving or dispersing the first thickener raw material in the first solvent to obtain a first mixed solution;

dissolving or dispersing the second thickener raw material in the second solvent to obtain a second mixed solution; and mixing the first mixed solution, the second mixed solution, and the first lubricating oil, and reacting the first thickener raw material and the second thickener raw material to produce a thickener.

Also in this case, a raw material of grease containing a thickener can be produced. The obtained raw material of grease can be mixed with a base oil to provide grease having oil retention ensured by mixing with a base oil.

(9) In the method for producing a raw material of grease according to (8), it is preferable to remove the first solvent and the second solvent after producing the thickener.

(10) In the method for producing a raw material of grease according to (8) or (9), it is preferable that the first lubricating oil is poly-α-olefin.

(11) Still another method for producing a raw material of grease of the present disclosure includes:

preparing a thickener;

a first lubricating oil; and a first solvent that has a boiling point lower than that of the first lubricating oil, dissolves the first lubricating oil, and does not dissolve the thickener; and dissolving the first lubricating oil in the first solvent to obtain a first solution, and impregnating the thickener with the obtained first solution.

Also in this case, a raw material of grease containing a thickener can be produced. The obtained raw material of grease can be mixed with a base oil to provide grease having oil retention ensured by mixing with a base oil.

(12) In the method for producing a raw material of grease according to (11), it is preferable to remove the first solvent after impregnating the thickener with the first solution.

(13) Still another method for producing a raw material of grease of the present disclosure includes:

preparing a thickener;

a first lubricating oil; and a first solvent that has a boiling point lower than that of the first lubricating oil, dissolves the first lubricating oil, and does not dissolve the thickener; and dispersing the thickener in the first solvent to obtain a first mixed solution, and adding the first lubricating oil to the obtained first mixed solution.

Also in this case, a raw material of grease containing a thickener can be produced. The obtained raw material of grease can be mixed with a base oil to provide grease having oil retention ensured by mixing with a base oil.

(14) In the method for producing a raw material of grease according to (13), it is preferable to remove the first solvent after adding the first lubricating oil to the first mixed solution.

(15) The method for producing grease of the present disclosure includes:

adding a third lubricating oil to a raw material of the grease produced by the production method according to (2), (5), or (8) described above, and then removing the first solvent and the second solvent.

According to this production method, it is possible to provide grease having ensured oil retention. In addition, the obtained grease can ensure good seizure resistance and good wear resistance when used for a rolling bearing or a sliding member.

(16) Another method for producing grease of the present disclosure includes:

adding a third lubricating oil to a raw material of grease produced by the production method according to (3), (6), (9), (12), or (14) described above.

According to this production method, it is possible to provide grease having ensured oil retention. In addition, the obtained grease can ensure good seizure resistance and good wear resistance when used for a rolling bearing or a sliding member.

(17) Still another method for producing grease of the present disclosure includes:

adding a third lubricating oil to a raw material of the grease produced by the production method according to (11) or (13) described above, and then, removing the first solvent.

According to this production method, it is possible to provide grease having ensured oil retention. In addition, the obtained grease can ensure good seizure resistance and good wear resistance when used for a rolling bearing or a sliding member.

(18) In the method for producing grease according to any one of (15) to (17), it is preferable that the third lubricating oil is at least one selected from ester oil, ether oil, poly-α-olefin (PAO), and mineral oil.

(19) Grease of the present disclosure includes:

a thickener, a base oil, and an additive, in which the thickener is a diurea compound;

the base oil is poly-α-olefin and a trimellitic acid ester; and an amount of the thickener is 20.0 to 40.0 mass %, an amount of the poly-α-olefin is 0.1 to 5.0 mass %, and an amount of the trimellitic acid ester is 59.9 to 75 mass %, with respect to the total amount of the thickener and the base oil.

The above grease has sufficient oil retention. Further, according to the grease, excellent wear resistance can be ensured when the grease is used for a rolling bearing or a sliding member.

Details of Embodiments of Invention of Present Disclosure

Hereinafter, embodiments of the present disclosure will be described with reference to the drawings.

Note that, in the present disclosure, embodiments of the invention should be considered to be illustrative in all respects and not restrictive. The scope of the present invention is defined by the claims, and is intended to include all modifications within the meaning and scope equivalent to the claims.

First, a device in which the grease related to the present disclosure is used and the like will be described, and then, embodiments of a raw material of grease, a method for producing a raw material of grease, a method for producing grease, and grease of the present disclosure will be described.

In the present specification, the grease related to the present disclosure is a concept including, in addition to the grease of the present disclosure, grease using a raw material of the grease of the present disclosure, grease using a raw material of the grease obtained by the method for producing a raw material of the grease of the present disclosure, and grease obtained by the method for producing grease of the present disclosure.

The grease related to the present disclosure is used for, for example, a dual pinion electric power steering device, a column type electric power steering device, a rolling bearing, and the like.

Dual Pinion Electric Power Steering Device

FIG. 1 is a configuration diagram schematically illustrating an example of a dual pinion electric power steering device 1 including a steering gear device 3.

Figure 2:
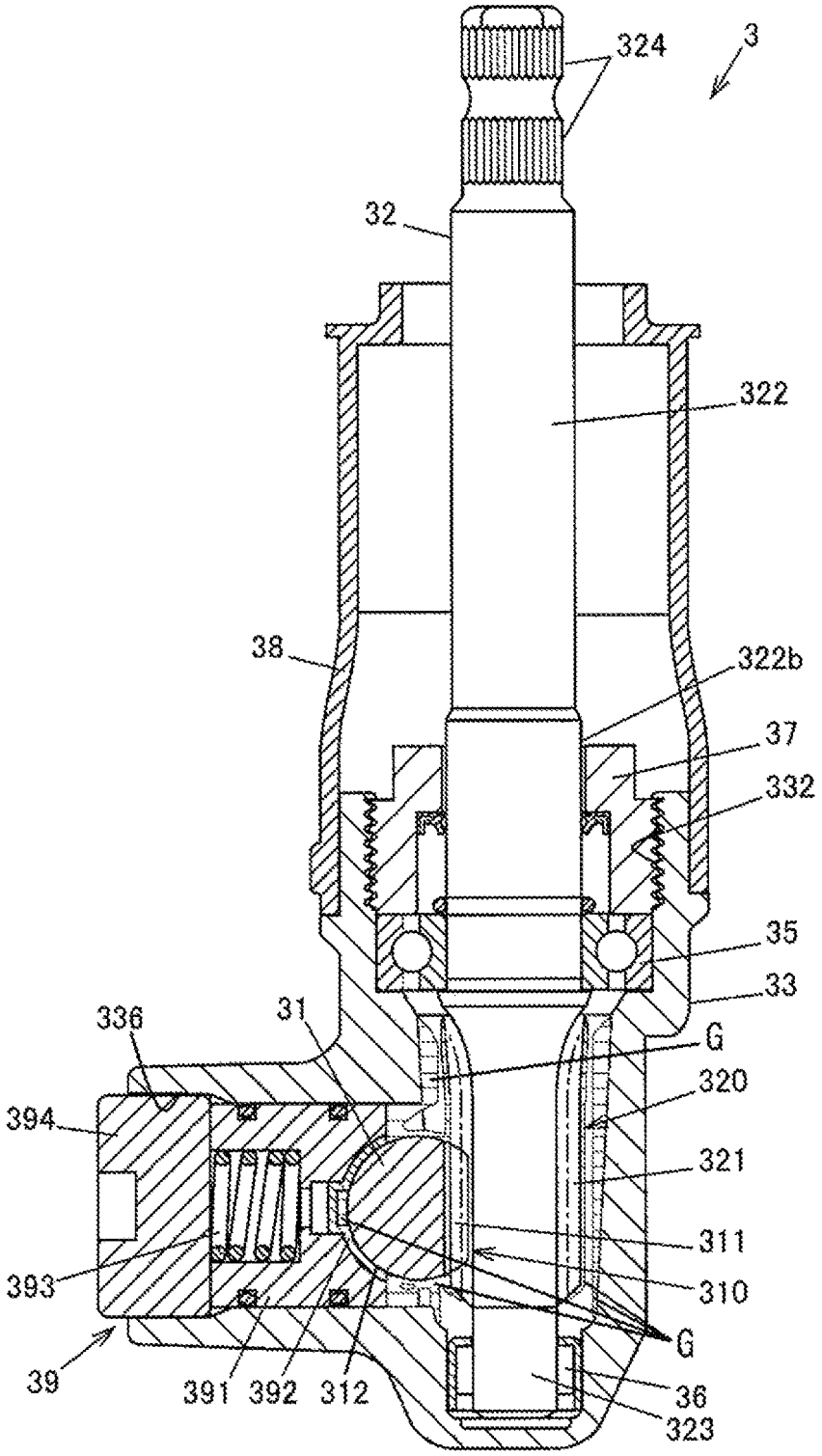
FIG. 2 is a cross-sectional view taken along line A-A of FIG. 1.

FIG. 2 is a cross-sectional view taken along line A-A of FIG. 1, illustrating a part of the steering gear device 3. In FIG. 2, the lower part of the drawing corresponds to the lower side in the vertical direction when mounted on a vehicle.

Figure 3:
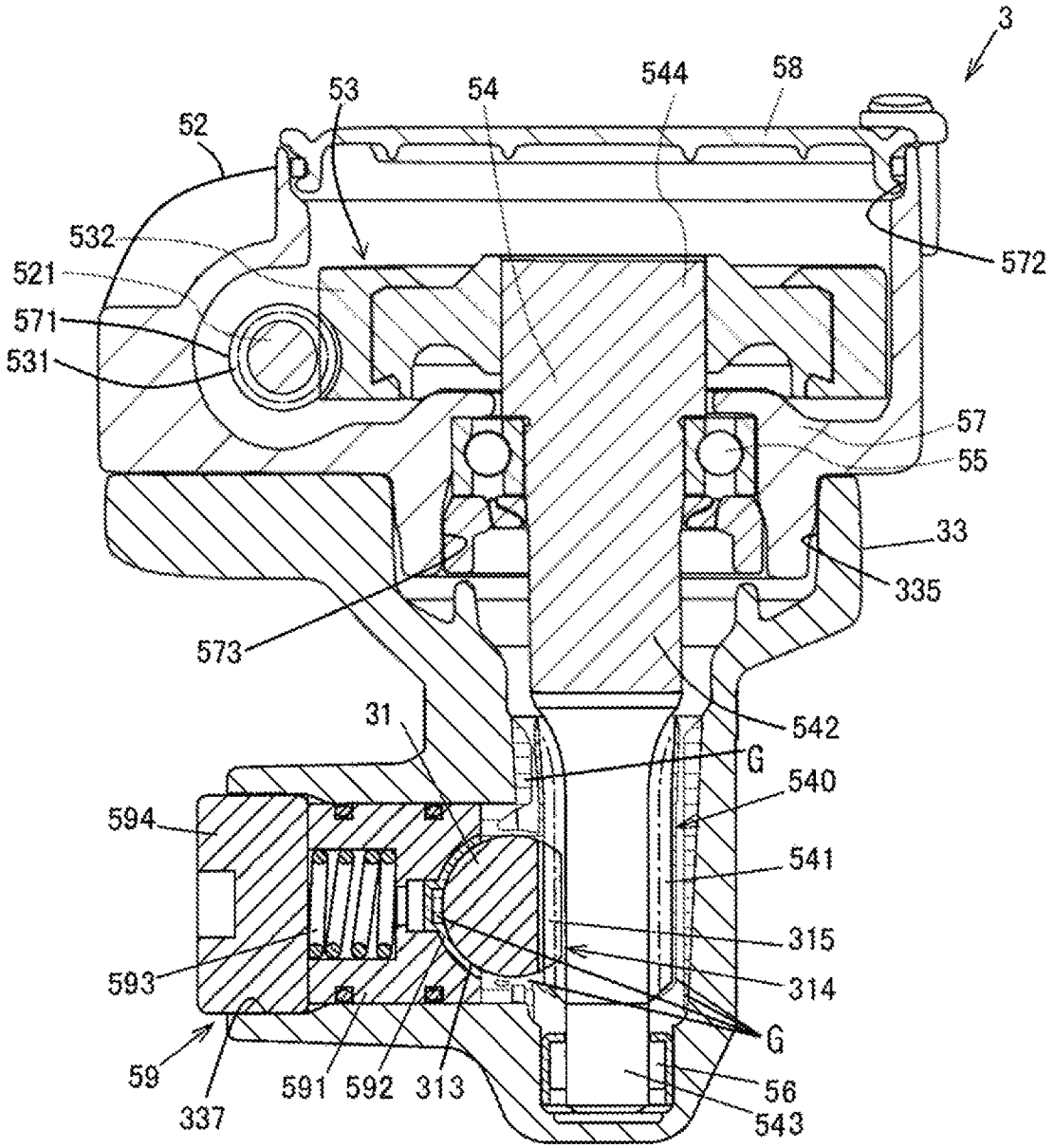
FIG. 3 is a cross-sectional view taken along line B-B of FIG. 1.

FIG. 3 is a cross-sectional view taken along line B-B of FIG. 1, illustrating a part of the steering gear device 3. In FIG. 3, the lower part of the drawing corresponds to the lower side in the vertical direction when mounted on a vehicle.

The dual pinion electric power steering device 1 includes a steering wheel 10, a steering shaft 2, a first pinion shaft 32, a rack shaft 31, a housing 33, two rack bushings 30 and 34, two bearings 35 and 36, a first rack guide mechanism 39, and a steering assistance device 5. The steering assistance device 5 includes a controller 50, a torque sensor 51, an electric motor 52, a speed reduction mechanism 53, a second pinion shaft 54, two bearings 55 and 56, a worm housing 57, and a second rack guide mechanism 59. The speed reduction mechanism 53 includes a worm 531 and a worm wheel 532.

A driver who drives an automobile including the dual pinion electric power steering device 1 performs a steering operation by rotating the steering wheel 10. The steering shaft 2 includes a column shaft 21, a first universal joint 23, an intermediate shaft 22, and a second universal joint 24. The first universal joint 23 includes a first yoke (not shown), a plurality of first rolling elements (not shown), a first cross shaft (not shown), a plurality of second rolling elements (not shown), and a second yoke (not shown). The second universal joint 24 includes a third yoke (not shown), a plurality of third rolling elements (not shown), a second cross shaft (not shown), a plurality of fourth rolling elements (not shown), and a fourth yoke (not shown).

The column shaft 21 fixes the steering wheel 10 to one end in the extending direction. The column shaft 21 fixes the first yoke of the first universal joint 23 to the other end in the extending direction. The column shaft 21 is rotatable about a central shaft in the extending direction. The first yoke is swingably fitted to a first pair of trunnions on the same central shaft of the first cross shaft via a plurality of first rolling elements. The second yoke is swingably fitted to a second pair of trunnions on the same central shaft of the first cross shaft via a plurality of second rolling elements. A central shaft of the first pair of trunnions and a central shaft of the second pair of trunnions intersect at an angle of 90 degrees.

The second yoke of the first universal joint 23 fixes one end of the intermediate shaft 22 in the extending direction. The intermediate shaft 22 fixes the third yoke of the second universal joint 24 to the other end in the extending direction. The third yoke is swingably fitted to a third pair of trunnions on the same central shaft of the second cross shaft via a plurality of third rolling elements. The fourth yoke is swingably fitted to a fourth pair of trunnions on the same central shaft of the second cross shaft via a plurality of fourth rolling elements. A central shaft of the third pair of trunnions and a central shaft of the fourth pair of trunnions intersect at an angle of 90 degrees. The fourth yoke of the second universal joint 24 fixes one end of the first pinion shaft 32 in the extending direction. As a result, when the driver rotates the steering wheel 10, the column shaft 21 rotates about a central shaft in the extending direction thereof, the intermediate shaft 22 also rotates about a central shaft in the extending direction thereof, and the first pinion shaft 32 also rotates about a central shaft in the extending direction thereof.

In the dual pinion electric power steering device 1, the first pinion shaft 32, the rack shaft 31, the housing 33, the two rack bushings 30 and 34, the first bearing 35, the second bearing 36, the first rack guide mechanism 39, the electric motor 52, the speed reduction mechanism 53, the second pinion shaft 54, the third bearing 55, the fourth bearing 56, the worm housing 57, and the second rack guide mechanism 59 constitute a steering gear device 3 as a rack and pinion steering device. In FIG. 1, the housing 33 is represented by an imaginary line (two-dot chain line), and the inside thereof is illustrated.

The first pinion shaft 32 extends from the upper side to the lower side in the vertical direction of an automobile. The first pinion shaft 32 has a serration portion 324, a first shaft portion 322, a first pinion tooth portion 320, and a first boss portion 323 from one end side to the other end along the extending direction. Serrations are formed in the serration portion 324. The fourth yoke of the second universal joint 24 is fixed to the serration of the serration portion 324. The first shaft portion 322 has a cylindrical shape. The first pinion teeth 321 are formed on the entire circumferential surface of the first pinion tooth portion 320. The extending direction of the first pinion teeth 321 has an angle that is not 90 degrees with respect to the extending direction of the central shaft of the first pinion shaft 32. The first boss portion 323 has a cylindrical shape.

The housing 33 has a first opening 332 on the steering wheel 10 side, and a side opposite to the first opening 332 is sealed. The first pinion shaft 32 is housed inside the housing 33. The first pinion shaft 32 is rotatably supported by two bearings 35 and 36 with respect to the housing 33. The first bearing 35 is a ball bearing. The first bearing 35 includes an inner ring, an outer ring, and a ball, the inner ring is fixed to the first shaft portion 322, the outer ring is fixed to the housing 33, and the ball rolls between the inner ring and the outer ring. The second bearing 36 is a roller bearing. The second bearing 36 includes a roller and an outer ring, the outer ring is fixed to the housing 33, and the roller rolls between the outer peripheral surface of the first boss portion 323 and the outer ring.

In a state where the first pinion shaft 32, the first bearing 35 and the second bearing 36 are inserted into the housing 33, a lid 37 through which the first pinion shaft 32 passes is fixed to the first opening 332 of the housing. A seal is fixed to the lid 37, and the seal is slidable on an outer peripheral surface 322*b* of the first shaft portion 322 of the first pinion shaft 32. A cover member 38 is further fixed to the housing 33. The cover member 38 covers a part of the first shaft portion 322 of the first pinion shaft 32 from the outside in the radial direction.

The rack shaft 31 includes a first columnar portion 316, a first rack tooth portion 310, a second columnar portion 317, a second rack tooth portion 314, and a third columnar portion 318, from one end to the other end in the extending direction. The first rack teeth 311 are formed in a part of the first rack tooth portion 310 in the circumferential direction, and the other part in the circumferential direction is a cylindrical surface 312 with the extending direction of the rack shaft 31 as a central shaft. The second rack teeth 315 are formed in a part of the second rack tooth portion 314 in the circumferential direction, and the other part in the circumferential direction is a cylindrical surface 313 with the extending direction of the rack shaft 31 as a central shaft. The outer peripheral surface of the first columnar portion 316, the outer peripheral surface of the second columnar portion 317 and the outer peripheral surface of the third columnar portion 318 are cylindrical surfaces with the extending direction of the rack shaft 31 as a central shaft. The extending direction of the first rack teeth 311 has an angle that is not 90 degrees with respect to the extending direction of the rack shaft. The extending direction of the second rack teeth 315 has an angle that is not 90 degrees with respect to the extending direction of the rack shaft 31. When the angle of the first rack teeth 311 with respect to the extending direction of the rack shaft 31 is defined as X, the angle of the second rack teeth 315 with respect to the extending direction of the rack shaft 31 is $\pi$-X.

The housing 33 extends in a direction different from the first opening 332 on the steering wheel 10 side, and has a second opening 333 at one end and a third opening 334 at the other end in the extending direction. The rack shaft 31 is housed inside the housing 33 along the extending direction of the housing 33. The first columnar portion 316 at one end of the rack shaft 31 in the extending direction protrudes from the second opening 333 at one end of the housing 33 in the extending direction. The third columnar portion 318 at the other end in the extending direction of the rack shaft 31 protrudes from the third opening 334 at the other end in the extending direction of the housing 33. The housing 33 has a fourth opening 335. The fourth opening 335 is located closer to the other end side in the extending direction of the housing than the first opening 332. The housing 33 further has a fifth opening 336 and a sixth opening 337. The fifth opening 336 is in a radial direction with the extending direction of the housing 33 as a central shaft at substantially the same position in the extending direction of the housing 33 as the first opening 332, and is in a direction perpendicular to the first opening 332. The sixth opening 337 is in a radial direction with the extending direction of the housing 33 as a central shaft at substantially the same position in the extending direction of the housing 33 as the fourth opening 335, and is in a direction perpendicular to the fourth opening 335.

The first rack bushing 30 is fixed to one end of the housing 33 in the extending direction. The first rack bushing 30 is fixed to the housing 33 adjacent the second opening 333. The first rack bushing 30 is slidable on the outer peripheral surface of the first columnar portion 316 of the rack shaft 31. A second rack bushing 34 is fixed to the other end of the housing 33 in the extending direction. The second rack bushing 34 is fixed to the housing 33 adjacent the third opening 334. The second rack bushing 34 is slidable on the outer peripheral surface of the third columnar portion 318 of the rack shaft 31.

The first pinion teeth 321 formed on the first pinion tooth portion 320 of the first pinion shaft 32 and the first rack teeth 311 formed on the first rack tooth portion 310 of the rack shaft 31 are roll slidably in contact with each other via grease G. The first pinion teeth 321 and the first rack teeth 311 mesh with each other via the grease G. When the first pinion shaft 32 rotates with respect to the housing 33 about the central shaft in the extending direction thereof, the rack shaft 31 moves in a linear direction with respect to the housing 33 in the extending direction of the housing 33.

The first rack guide mechanism 39 is fixed to the housing 33. The first rack guide mechanism 39 is fixed to the fifth opening 336. The fifth opening 336 is on the side of the cylindrical surface 312 which is the other part in the circumferential direction of the first rack tooth portion 310 of the rack shaft 31 at a position where the first pinion shaft 32 in the extending direction of the housing 33 meshes with the rack shaft 31.

The first rack guide mechanism 39 includes a first support yoke 391, a first sheet member 392, a first coil spring 393, and a first plug 394. The first sheet member 392 is sandwiched between the cylindrical surface 312 which is the other part in the circumferential direction of the first rack tooth portion 310 of the rack shaft 31 and the cylindrical surface of the first support yoke 391. The first sheet member 392 is fixed to the first support yoke 391. The first sheet member 392 and the cylindrical surface 312 which is the other part in the circumferential direction of the first rack tooth portion 310 of the rack shaft 31 are slidably in contact with each other via the grease G. The first plug 394 is fixed to the fifth opening 336 of the housing 33. The first plug 394 contacts one end of the first coil spring 393. The first support yoke 391 contacts the other end of the first coil spring 393. The first coil spring 393 is shorter than a free length in a state where the first plug 394 is fixed to the fifth opening 336. Thus, the first sheet member 392 is pressed against the rack shaft 31 with respect to the housing 33.

The second pinion shaft 54 extends from the upper side to the lower side in the vertical direction of an automobile. The second pinion shaft 54 has a fitting portion 544, a second shaft portion 542, a second pinion tooth portion 540, and a second boss portion 543 from one end side to the other end along the extending direction. The fitting portion 544 has a cylindrical shape. The second shaft portion 542 has a cylindrical shape. The second pinion teeth 541 are formed on the entire circumferential surface of the second pinion tooth portion 540. The extending direction of the second pinion teeth 541 has an angle that is not 90 degrees with respect to the extending direction of the central shaft of the second pinion shaft 54. The second boss portion 543 has a cylindrical shape.

The worm wheel 532 is fitted to the fitting portion 544. The worm 531 is fixed to an output shaft 521 of the electric motor 52. The electric motor 52 is fixed to the worm housing 57. The worm housing 57 has a seventh opening 571. The output shaft 521 of the electric motor 52 is disposed in an internal space of the worm housing 57 via the seventh opening 571. The electric motor 52 is fixed to the worm housing 57 so as to close the seventh opening 571 of the worm housing 57.

The worm 531 is disposed in the internal space of the worm housing 57. The worm wheel 532 is disposed in the internal space of the worm housing 57. The worm housing 57 has an eighth opening 572 vertically upward, and an assembly of the second pinion shaft 54 and the worm wheel 532 is inserted into the internal space of the worm housing 57 from the eighth opening 572. The eighth opening is closed with a lid 58. The worm housing 57 has a ninth opening 573 opposite the eighth opening 572. A part of the second shaft portion 542 of the second pinion shaft 54, the second pinion tooth portion 540, and the second boss portion 543 protrude from the ninth opening 573 of the worm housing 57.

The worm housing 57 is fixed to the housing 33. The ninth opening 573 of the worm housing 57 communicates with the fourth opening 335 of the housing 33 to seal the internal space from an external space.

The third bearing 55 is a ball bearing. The bearing 55 includes an inner ring, an outer ring, and a ball, the inner ring is fixed to the second shaft portion 542, the outer ring is fixed to the worm housing 57, and the ball rolls between the inner ring and the outer ring. The bearing 56 is a roller bearing. The bearing 56 includes a roller and an outer ring, the outer ring is fixed to the housing 33, and the roller rolls between the outer peripheral surface of the second boss portion 543 and the outer ring.

The second pinion teeth 541 formed on the second pinion tooth portion 540 of the second pinion shaft 54 and the second rack teeth 315 formed on the second rack tooth portion 314 of the rack shaft 31 are roll slidably in contact with each other via the grease G. The second pinion teeth 541 and the second rack teeth 315 mesh with each other via the grease G. When the second pinion shaft 54 rotates with respect to the housing 33 about the central shaft in the extending direction thereof, the rack shaft 31 moves in a linear direction with respect to the housing 33 in the extending direction of the housing 33.

The second rack guide mechanism 59 is fixed to the housing 33. The second rack guide mechanism 59 is fixed to the sixth opening 337. The sixth opening 337 is on the side of the cylindrical surface 313 which is the other part in the circumferential direction of the second rack tooth portion 314 of the rack shaft 31 at a position where the second pinion shaft 54 in the extending direction of the housing 33 meshes with the rack shaft 31.

The second rack guide mechanism 59 includes a second support yoke 591, a second sheet member 592, a second coil spring 593, and a second plug 594. The second sheet member 592 is sandwiched between the cylindrical surface 313 which is the other part in the circumferential direction of the second rack tooth portion 314 of the rack shaft 31 and the cylindrical surface of the second support yoke 591. The second sheet member 592 is fixed to the second support yoke 591. The second sheet member 592 and the cylindrical surface 313 which is the other part in the circumferential direction of the second rack tooth portion 314 of the rack shaft 31 are slidably in contact with each other via the grease G. The second plug 594 is fixed to the sixth opening 337 of the housing 33. The second plug 594 contacts one end of the second coil spring 593. The second support yoke 591 contacts the other end of the second coil spring 593. The second coil spring 593 is shorter than a free length in a state where the second plug 594 is fixed to the sixth opening 337. Thus, the second sheet member 592 is pressed against the rack shaft 31 with respect to the housing 33.

The torque sensor 51 detects a steering torque applied to the steering wheel 10 by the driver with the column shaft 21. The speed reduction mechanism 53 is an assembly in which the worm 531 that rotates integrally with the output shaft 521 of the electric motor 52 and the worm wheel 532 that rotates integrally with the second pinion shaft 54 are meshed with each other. A motor current is supplied from the controller 50 to the electric motor 52. The controller 50 controls the electric motor 52 on the basis of the steering torque, vehicle speed and the like detected by the torque sensor 51, and transmits a rotational force of the output shaft 521 of the electric motor 52 decelerated by the speed reduction mechanism 53 to the second pinion shaft 54. The rotational force of the second pinion shaft 54 is applied from the second pinion teeth 541 to the second rack teeth 315 as a steering assist force.

The housing 33 is fixed to an automobile (not shown) such that the extending direction of the housing 33 coincides with the vehicle width direction. Ball joint sockets 11 and 11 are fixed to one end and the other end of the rack shaft 31, respectively, and tie rods 12 and 12 respectively connected to the ball joint sockets 11 and 11 are connected to a bearing ring of a rolling bearing rotatably supporting a pair of left and right front wheels 14 and 14 via knuckle arms 13 and 13. The rack shaft 31 moves in the linear direction in the extending direction of the housing 33 to steer the left and right front wheels 14 and 14 as steering wheels.

The grease G is sealed in the housing 33. The grease G is interposed between the rolling sliding surface of the first pinion teeth 321 and the rolling sliding surface of the first rack teeth 311 where the first pinion teeth 321 and the first rack teeth 311 come into contact by meshing with each other, thereby lubricating between the rolling sliding surfaces. The grease G is interposed between the sliding surface of the first sheet member 392 and the sliding surface of the cylindrical surface 312 which is the other part in the circumferential direction of the first rack tooth portion 310 of the rack shaft 31 where the first sheet member 392 and the rack shaft 31 come into contact by being pressed against each other, thereby lubricating between the sliding surfaces. The grease G is interposed between the rolling sliding surface of the second pinion teeth 541 and the rolling sliding surface of the second rack teeth 315 where the second pinion teeth 541 and the second rack teeth 315 come into contact by meshing with each other, thereby lubricating between the rolling sliding surfaces. The grease G is interposed between the sliding surface of the second sheet member 592 and the sliding surface of the cylindrical surface 313 which is the other part in the circumferential direction of the second rack tooth portion 314 of the rack shaft 31 where the second sheet member 592 and the rack shaft 31 come into contact by being pressed against each other, thereby lubricating between the sliding surfaces.

In the steering gear device 3 configured as described above, the grease related to the present disclosure is sealed as the grease G. Since the grease related to the present disclosure ensures oil retention, the steering gear device 3 has good seizure resistance and wear resistance.

Figure 4:
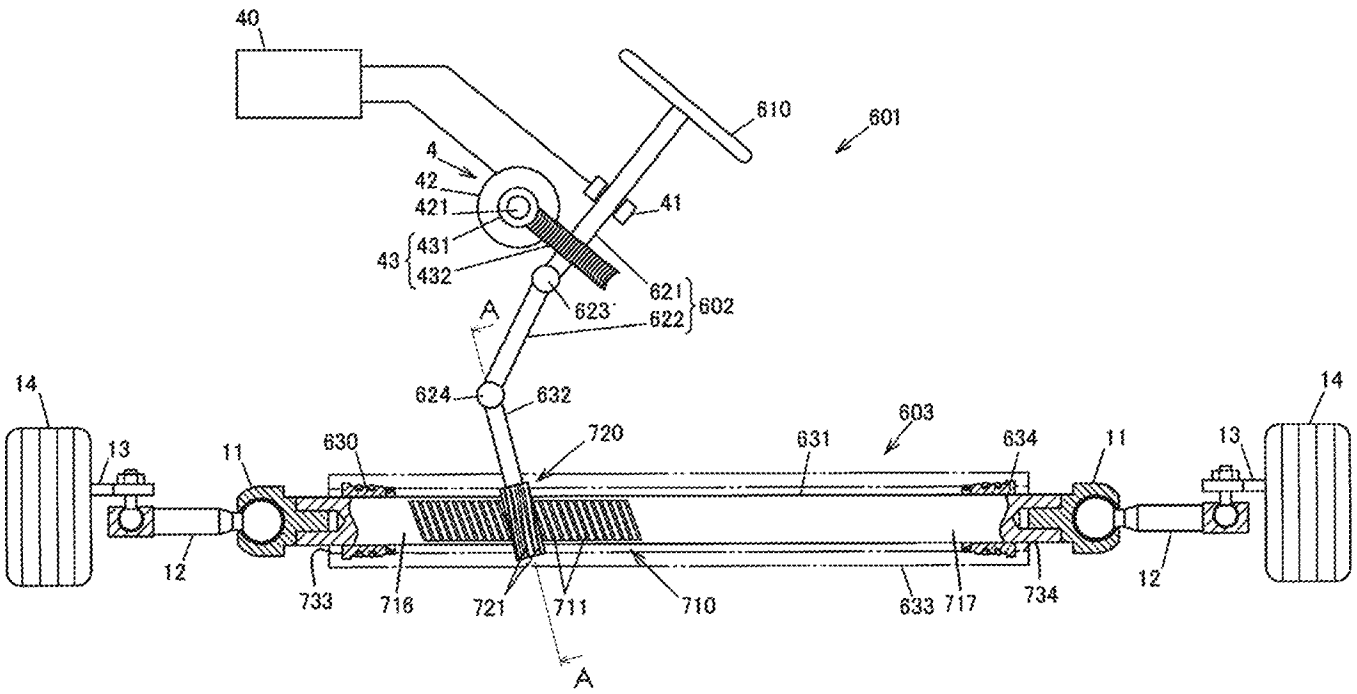
FIG. 4 is a configuration diagram schematically illustrating an example of a column type electric power steering device in which grease related to the present disclosure is sealed.

FIG. 4 is a configuration diagram schematically illustrating an example of a column type electric power steering device 601 including a steering gear device 603.

Figure 5:
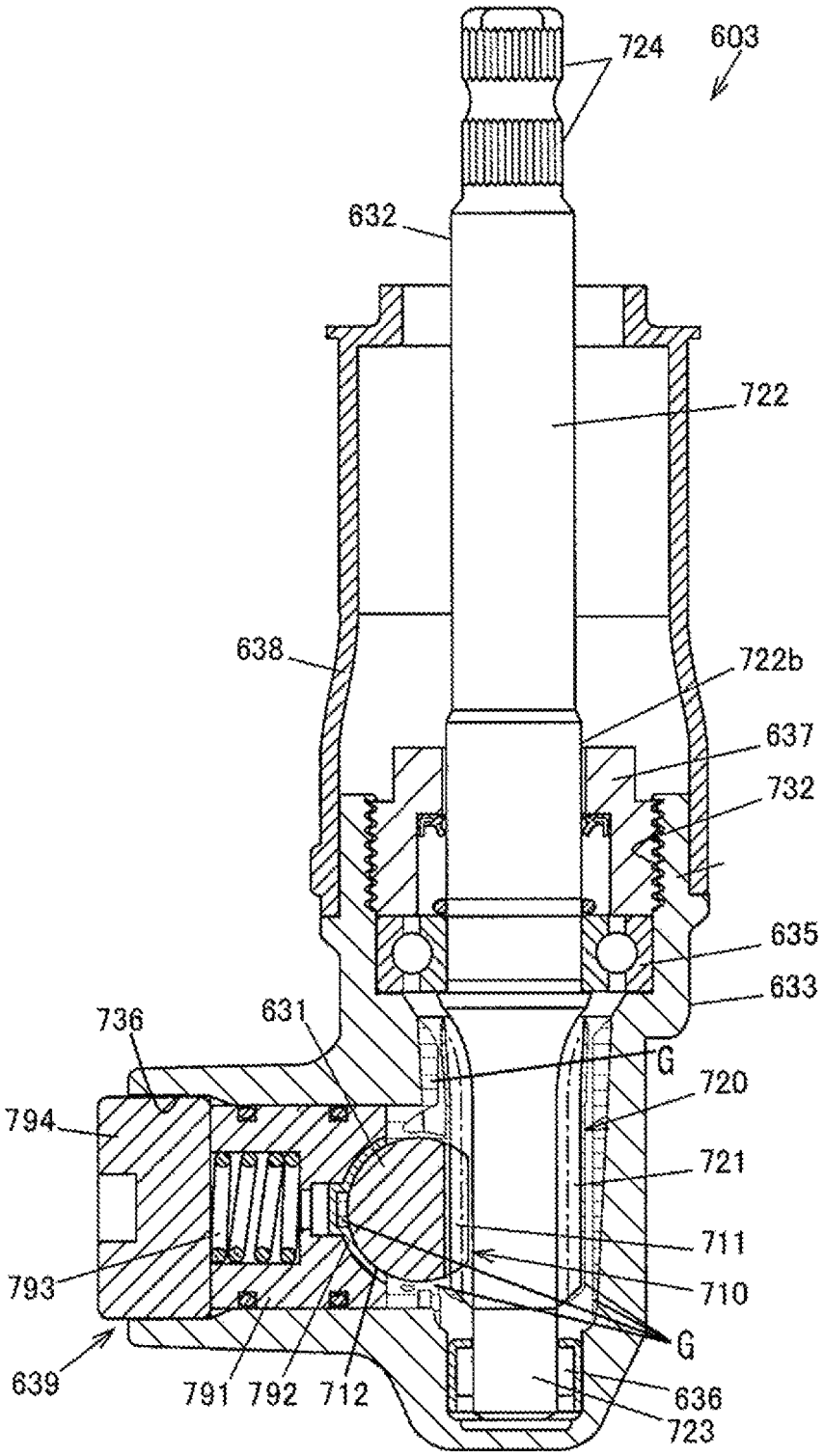
FIG. 5 is a cross-sectional view taken along line A-A of FIG. 4.

FIG. 5 is a cross-sectional view taken along line A-A of FIG. 4, illustrating a part of the steering gear device 603. In FIG. 5, the lower part of the drawing corresponds to the lower side in the vertical direction when mounted on a vehicle.

The column type electric power steering device 601 includes a steering wheel 610, a steering shaft 602, a pinion shaft 632, a rack shaft 631, a housing 633, two rack bushings 630 and 634, two bearings 635 and 636, a rack guide mechanism 639, and a steering assistance device 4. A driver who drives an automobile including the column type electric power steering device 601 performs a steering operation by rotating the steering wheel 610. The steering shaft 602 includes a column shaft 621, a first universal joint 623, an intermediate shaft 622, and a second universal joint 624. The first universal joint 623 includes a first yoke (not shown), a plurality of first rolling elements (not shown), a first cross shaft (not shown), a plurality of second rolling elements (not shown), and a second yoke (not shown). The second universal joint 624 includes a third yoke (not shown), a plurality of third rolling elements (not shown), a second cross shaft (not shown), a plurality of fourth rolling elements (not shown), and a fourth yoke (not shown).

The column shaft 621 fixes the steering wheel 610 to one end in the extending direction. The column shaft 621 fixes the first yoke of the first universal joint 623 to the other end in the extending direction. The column shaft 621 is rotatable about a central shaft in the extending direction. The first yoke is swingably fitted to a first pair of trunnions on the same central shaft of the first cross shaft via a plurality of first rolling elements. The second yoke is swingably fitted to a second pair of trunnions on the same central shaft of the first cross shaft via a plurality of second rolling elements. A central shaft of the first pair of trunnions and a central shaft of the second pair of trunnions intersect at an angle of 90 degrees.

The second yoke of the first universal joint 623 fixes one end of the intermediate shaft 622 in the extending direction. The intermediate shaft 622 fixes the third yoke of the second universal joint 624 to the other end in the extending direction. The third yoke is swingably fitted to a third pair of trunnions on the same central shaft of the second cross shaft via a plurality of third rolling elements. The fourth yoke is swingably fitted to a fourth pair of trunnions on the same central shaft of the second cross shaft via a plurality of fourth rolling elements. A central shaft of the third pair of trunnions and a central shaft of the fourth pair of trunnions intersect at an angle of 90 degrees. The fourth yoke of the second universal joint 624 fixes one end of the pinion shaft 632 in the extending direction. As a result, when the driver rotates the steering wheel 610, the column shaft 621 rotates about the central shaft in the extending direction thereof, the intermediate shaft 622 also rotates about the central shaft in the extending direction thereof, and the pinion shaft 632 also rotates about the central shaft in the extending direction thereof.

In the column type electric power steering device 601, the pinion shaft 632, the rack shaft 631, the housing 633, the two rack bushings 630 and 634, the two bearings 635 and 636, and the rack guide mechanism 639 constitute the steering gear device 603 as a rack and pinion steering device. In FIG. 4, the housing 633 is represented by an imaginary line (two-dot chain line), and the inside thereof is illustrated.

The pinion shaft 632 extends from the upper side to the lower side in the vertical direction of an automobile. The pinion shaft 632 has a serration portion 724, a shaft portion 722, a pinion tooth portion 720, and a boss portion 723 from one end side to the other end along the extending direction. Serrations are formed in the serration portion 724. The fourth yoke of the second universal joint 624 is fixed to the serration of the serration portion 724. The shaft portion 722 has a cylindrical shape. Pinion teeth 721 are formed on the entire circumferential surface of the pinion tooth portion 720. The extending direction of the pinion teeth 721 has an angle that is not 90 degrees with respect to the extending direction of the central shaft of the pinion shaft 632. The boss portion 723 has a cylindrical shape.

The housing 633 has a first opening 732 on the steering wheel 610 side, and a side opposite to the first opening 732 is sealed. The pinion shaft 632 is housed inside the housing 633. The pinion shaft 632 is rotatably supported by two bearings 635 and 636 with respect to the housing 633. The bearing 635 is a ball bearing. The bearing 635 includes an inner ring, an outer ring, and a ball, the inner ring is fixed to the shaft portion 722, the outer ring is fixed to the housing 633, and the ball rolls between the inner ring and the outer ring. The bearing 636 is a roller bearing. The bearing 636 includes a roller and an outer ring, the outer ring is fixed to the housing 633, and the roller rolls between the outer peripheral surface of the boss portion 723 and the outer ring.

In a state where the pinion shaft 632 and the two bearings 635 and 636 are inserted into the housing 633, a lid 637 through which the pinion shaft 632 passes is fixed to the first opening 732 of the housing. A seal is fixed to the lid 637, and the seal is slidable on an outer peripheral surface 722*b* of the shaft portion 722 of the pinion shaft 632. A cover member 638 is further fixed to the housing 633. The cover member 638 covers a part of the shaft portion 722 of the pinion shaft 632 from the outside in the radial direction.

The rack shaft 631 includes a first columnar portion 716, a rack tooth portion 710, and a second columnar portion 717, from one end to the other end in the extending direction. The rack teeth 711 are formed in a part of the rack tooth portion 710 in the circumferential direction, and the other part in the circumferential direction is a cylindrical surface 712 with the extending direction of the rack shaft 631 as a central shaft. The outer peripheral surface of the first columnar portion 716 and the outer peripheral surface of the second columnar portion 717 are cylindrical surfaces with the extending direction of the rack shaft 631 as a central shaft. The extending direction of the rack teeth 711 has an angle that is not 90 degrees with respect to the extending direction of the rack shaft 631.

The housing 633 extends in a direction different from the first opening 732 on the steering wheel 610 side, and has a second opening 733 at one end and a third opening 734 at the other end in the extending direction. The rack shaft 631 is housed inside the housing 633 along the extending direction of the housing 633. One end of the rack shaft 631 in the extending direction protrudes from the second opening 733 at one end of the housing 633 in the extending direction. The other end of the rack shaft 631 in the extending direction protrudes from the third opening 734 at the other end of the housing 633 in the extending direction.

A first rack bushing 630 is fixed to one end of the housing 633 in the extending direction. The first rack bushing 630 is fixed to the housing 633 adjacent the second opening 733. The first rack bushing 630 is slidable on the outer peripheral surface of the first columnar portion 716 of the rack shaft 631. A second rack bushing 634 is fixed to the other end of the housing 633 in the extending direction. The second rack bushing 634 is fixed to the housing 633 adjacent the third opening 734. The second rack bushing 634 is slidable on the outer peripheral surface of the second columnar portion 717 of the rack shaft 631.

The pinion teeth 721 formed on the pinion tooth portion 720 of the pinion shaft 632 and the rack teeth 711 formed on the rack tooth portion 710 of the rack shaft 631 are roll slidably in contact with each other via the grease G. The pinion teeth 721 mesh with the rack teeth 711 via the grease G. When the pinion shaft 632 rotates with respect to the housing 633 about the central shaft in the extending direction thereof, the rack shaft 631 moves in a linear direction with respect to the housing 633 in the extending direction of the housing 633.

The housing 633 is fixed to an automobile (not shown) such that the extending direction of the housing 633 coincides with the vehicle width direction. Ball joint sockets 11 and 11 are fixed to one end and the other end of the rack shaft 631, respectively, and tie rods 12 and 12 respectively connected to the ball joint sockets 11 and 11 are connected to a bearing ring of a rolling bearing rotatably supporting a pair of left and right front wheels 14 and 14 via knuckle arms 13 and 13. The rack shaft 631 moves in the linear direction in the extending direction of the housing 633 to steer the left and right front wheels 14 and 14 as steering wheels.

The rack guide mechanism 639 is fixed to the housing 633. The housing 633 has a fourth opening 736 on the cylindrical surface 712 side which is the other part in the circumferential direction of the rack tooth portion 710 of the rack shaft 631 at a position where the pinion shaft 632 in the extending direction meshes with the rack shaft 631.

The rack guide mechanism 639 includes a support yoke 791, a sheet member 792, a coil spring 793, and a plug 794. The sheet member 792 is sandwiched between the cylindrical surface 712 which is the other part in the circumferential direction of the rack tooth portion 710 of the rack shaft 631, and the cylindrical surface of the support yoke 791. The sheet member 792 is fixed to the support yoke 791. The sheet member 792 and the cylindrical surface 712 which is the other portion in the circumferential direction of the rack tooth portion 710 of the rack shaft 631 are slidably in contact with each other via the grease G. The plug 794 is fixed to the fourth opening 736 of the housing 633. The plug 794 contacts one end of the coil spring 793. The support yoke 791 contacts the other end of the coil spring 793. The coil spring 793 is shorter than a free length in a state where the plug 794 is fixed to the fourth opening 736. Thus, the sheet member 792 is pressed against the rack shaft 631 with respect to the housing 633.

The steering assistance device 4 includes a controller 40, a torque sensor 41 that detects the steering torque applied to the steering wheel 610 by the driver, an electric motor 42, and a speed reduction mechanism 43 that reduces a rotational force of an output shaft 421 of the electric motor 42 and transmits the reduced rotational force to the column shaft 621. The speed reduction mechanism 43 is an assembly in which a worm 431 that rotates integrally with the output shaft 421 of the electric motor 42 and a worm wheel 432 that rotates integrally with the column shaft 621 are meshed with each other. A motor current is supplied from the controller 40 to the electric motor 42. The controller 40 controls the electric motor 42 on the basis of the steering torque, vehicle speed and the like detected by the torque sensor 41, and the rotational force of the output shaft 421 of the electric motor 42 decelerated by the speed reduction mechanism 43 is applied to the column shaft 621 as a steering assist force.

The grease G is sealed in the housing 633. The grease G is interposed between the rolling sliding surface of the pinion teeth 721 and the rolling sliding surface of the rack teeth 711 where the pinion teeth 721 and the rack teeth 711 come into contact by meshing with each other, thereby lubricating between the rolling sliding surfaces. The grease G is interposed between the sliding surface of the sheet member 792 and the sliding surface of the cylindrical surface 712 which is the other part in the circumferential direction of the rack tooth portion 710 of the rack shaft 631 where the sheet member 792 and the rack shaft 631 come into contact by being pressed against each other, thereby lubricating between the sliding surfaces.

In the steering gear device 603 configured as described above, the grease related to the present disclosure is sealed as the grease G. Since the grease related to the present disclosure ensures oil retention, the steering gear device 603 has good seizure resistance and wear resistance.

Rolling Bearing

Figure 6:
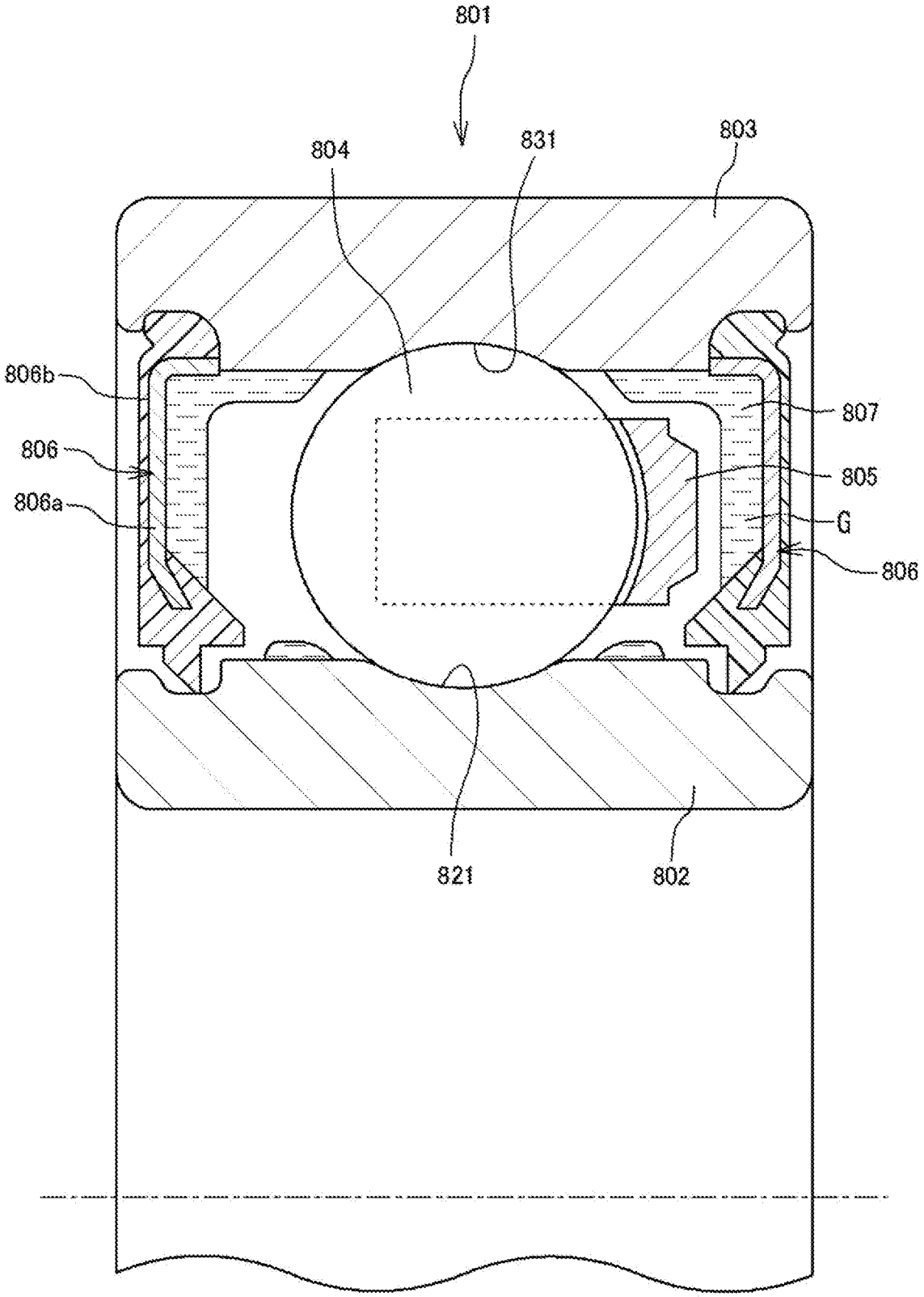
FIG. 6 is a cross-sectional view of a rolling bearing in which grease related to the present disclosure is sealed.

FIG. 6 is a cross-sectional view of a ball bearing 801 which is an example of a rolling bearing.

The ball bearing 801 includes an inner ring 802, an outer ring 803 provided radially outside the inner ring 802, balls 804 as a plurality of rolling elements provided between the inner ring 802 and the outer ring 803, and an annular cage 805 that holds the balls 804. Also, seals 806 are provided on one side and the other side in the axial direction of the ball bearing 801.

Furthermore, the grease G is sealed in an annular region 807 between the inner ring 802 and the outer ring 803.

An inner raceway surface 821 on which the balls 804 roll is formed on the outer periphery of the inner ring 802.

An outer raceway surface 831 on which the balls 804 roll is formed on the inner periphery of the outer ring 803.

A plurality of balls 804 are interposed between the inner raceway surface 821 and the outer raceway surface 831, and roll between the inner raceway surface 821 and the outer raceway surface 831.

The grease G sealed in the region 807 is also interposed at a contact portion between the ball 804 and the inner raceway surface 821 of the inner ring 802 and a contact portion between the ball 804 and the outer raceway surface 831 of the outer ring 803. Incidentally, the grease G is sealed so as to occupy 20 to 40 vol % with respect to the volume of the space excluding the ball 804 and the cage 805 from the space surrounded by the inner ring 802, the outer ring 803, and the seal 806.

The seal 806 is an annular member including an annular core metal **806*a* and an elastic member 806*b* fixed to the core metal 806*a*, and has a radially outer portion fixed to the outer ring 803 and a radially inner portion slidably attached to the inner ring 802. The seal 806** prevents the sealed grease G from leaking to the outside.

In the ball bearing 801 configured as described above, the grease related to the present disclosure is sealed as the grease G. Since the grease related to the present disclosure ensures oil retention, the ball bearing 801 has good seizure resistance and wear resistance.

The grease related to the present disclosure can be used by being sealed in the above-described dual pinion electric power steering device, column type electric power steering device, rolling bearing, and the like.

In the invention of the present disclosure, the raw material of grease refers to a mixture containing at least a thickener and a lubricating oil, which can produce grease by being mixed with the lubricating oil as a base oil.

Here, the lubricating oil contained in the raw material of grease may be the same as or different from the lubricating oil as a base oil.

An embodiment of the raw material of grease of the present disclosure may include, in addition to a thickener and a lubricating oil, a solvent that has a boiling point lower than that of the lubricating oil, dissolves the lubricating oil, and does not dissolve the thickener. Such raw material of grease can be produced, for example, by a method for synthesizing a thickener in a solvent rather than in a base oil.

Specifically, for example, the raw material of grease can be produced using the method for producing a raw material of grease of the present disclosure.

In the following description of the first to tenth embodiments, embodiments of a method for producing a raw material of grease, a method for producing grease, and grease of the present disclosure will be described using urea-based grease in which a thickener is a diurea compound as an example.

First Embodiment

Figure 7:
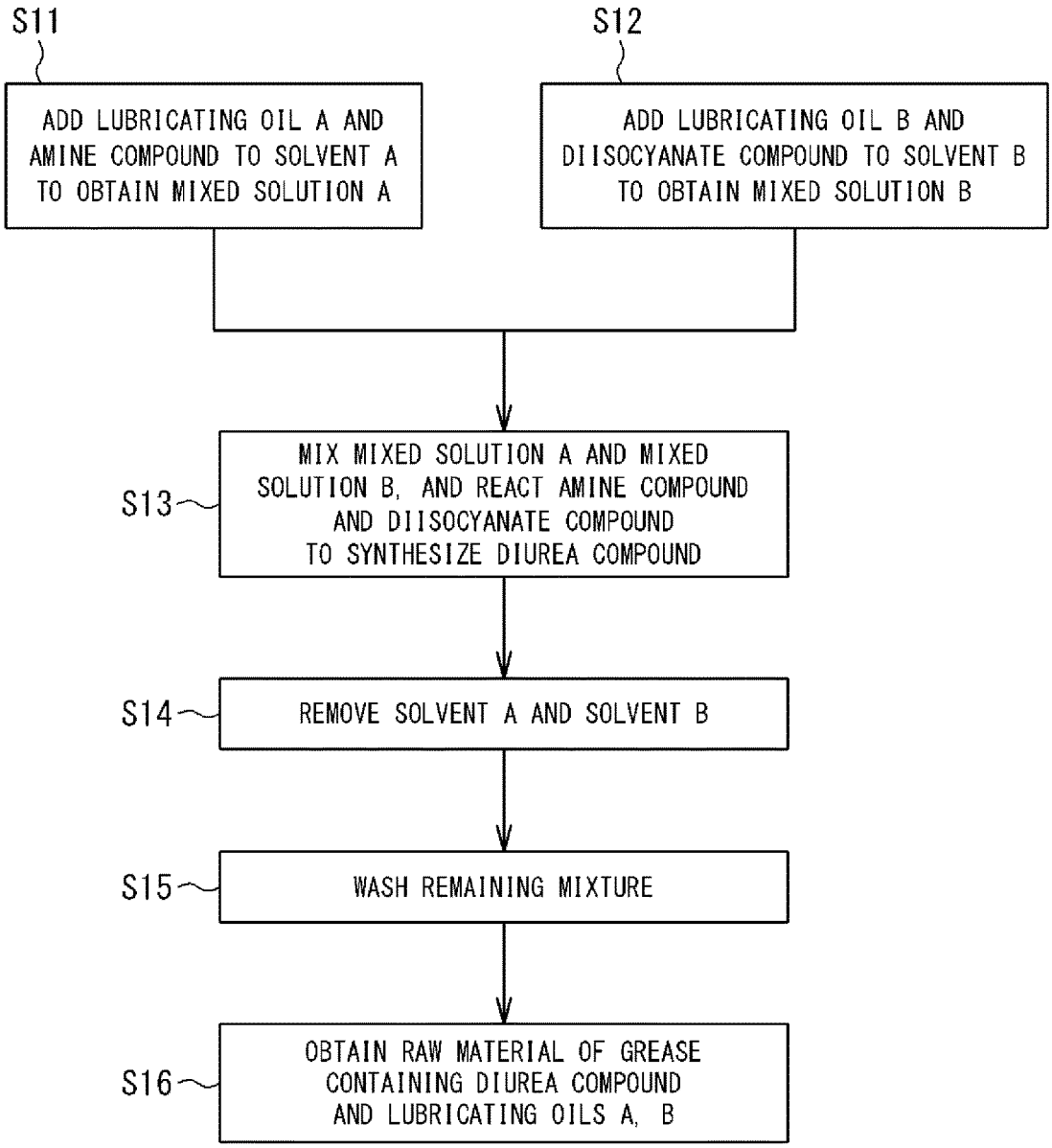
FIG. 7 is a flow chart for explaining a method for producing a raw material of grease of a first embodiment.

FIG. 7 is a flow chart for explaining a method for producing a raw material of grease of a first embodiment.

(1) In the present embodiment, first, a predetermined amount of each of an amine compound, a diisocyanate compound, a lubricating oil A, a lubricating oil B, a solvent A, and a solvent B is prepared.

The amine compound may be any amine compound known as an amine compound for synthesizing a diurea compound known as a thickener for urea-based grease.

The amine compound may be an aliphatic amine, an aromatic amine, or an alicyclic amine.

The aliphatic amine is not particularly limited, and examples thereof include aliphatic amines having 4 to 22 carbon atoms, and the carbon chain may be linear or branched.

The aromatic amine is not particularly limited, and examples thereof include 4-amino-1-methylbenzene (p-toluidine), 2-amino-1-methylbenzene (o-toluidine), 4-amino-1-dodecylbenzene, 2-amino-1-dodecylbenzene, aniline, naphthylamine, and the like.

The alicyclic amine is not particularly limited, and examples thereof include cyclohexylamine, 1-amino-2-methylcyclohexane, 1-amino-3-methylcyclohexane, 1-amino-4-methylcyclohexane, and the like.

The diisocyanate compound may be a diisocyanate compound known as a diisocyanate compound for synthesizing a diurea compound known as a thickener for urea-based grease.

The diisocyanate compound is not particularly limited, and examples thereof include hexamethylene diisocyanate (HDI), 2,4-toluene diisocyanate (2,4-TDI), 2,6-toluene diisocyanate (2,6-TDI), a mixture of 2,4-TDI and 2,6-TDI, 4,4'-diphenylmethane diisocyanate (MDI), and the like.

Examples of the lubricating oil A and the lubricating oil B include those used as base oils in grease. The lubricating oil A and the lubricating oil B may be the same or different.

Examples of the base oil (lubricating oil A, lubricating oil B) include ether oil such as alkyl diphenyl ether (ADE), ester oil, poly-α-olefin (PAO), polyalkylene glycol, fluorine oil, silicone oil, mineral oil, and the like.

The lubricating oil A and the lubricating oil B are preferably poly-α-olefin (PAO). More preferred poly-α-olefins are PAO6 and PAO8.

The solvent A may be any solvent that has a boiling point lower than those of the prepared lubricating oil A and lubricating oil B and dissolves the prepared lubricating oil A.

The solvent A may be any solvent that satisfies the above requirements in consideration of the amine compound, the diisocyanate compound, and the lubricating oil A. As a specific example of the solvent A, toluene, hexane, ethyl acetate, tetrahydrofuran, p-xylene, m-xylene, o-xylene, methyl acetate or the like can be used. Incidentally, it is preferable to avoid using a substance that reacts with a substance having an isocyanate group, such as a substance having an amine group or a substance having a hydroxyl group, or a substance that reacts with a substance having an amine group as the solvent A.

Also, the solvent A preferably has a viscosity lower than that of the prepared lubricating oil A.

In the present disclosure, the viscosities of the solvent and the lubricating oil are measured by the method of JIS Z 8803:2011 using a Cannon-Fenske viscometer.

The solvent B may be any solvent that has a boiling point lower than those of the prepared lubricating oil A and lubricating oil B and dissolves the prepared lubricating oil B.

The solvent B may be any solvent that satisfies the above requirements in consideration of the amine compound, the diisocyanate compound, and the lubricating oil B. As a specific example of the solvent B, toluene, hexane, ethyl acetate, tetrahydrofuran, p-xylene, m-xylene, o-xylene, methyl acetate or the like can be used. Incidentally, similarly to the solvent A, it is preferable to avoid using a substance that reacts with a substance having an isocyanate group, such as a substance having an amine group or a substance having a hydroxyl group, or a substance that reacts with a substance having an amine group as the solvent B.

The solvent B preferably has a viscosity lower than that of the prepared lubricating oil B.

The solvent B may be the same as or different from the solvent A, but is preferably the same.

In the subsequent step, when the mixed solution containing a solvent A and the mixed solution B containing a solvent B are mixed, both are reliably mixed, and thus it is suitable for proceeding a reaction between the amine compound and the diisocyanate compound. In addition, when the solvent A and the solvent B are removed in the subsequent step, it is easy to select a removal method and removal conditions.

(2) Next, the lubricating oil A and the amine compound are added to the solvent A to obtain a mixed solution A (S11).

At this time, the timing of adding the lubricating oil A and the amine compound to the solvent A is not particularly limited, and (a) the lubricating oil A may be dissolved in the solvent A to prepare a solution, and then the amine compound may be dissolved or dispersed in the obtained solution to obtain a mixed solution A;

(b) the amine compound may be dissolved or dispersed in the solvent A to prepare a mixed solution, and then the lubricating oil A may be dissolved in the obtained mixed solution to obtain a mixed solution A; or (c) the amine compound and the lubricating oil A may be simultaneously added to the solvent A, and then all the components may be mixed to obtain a mixed solution A.

At this time, the amount of the amine compound may be about 5 to 60 mass % with respect to 100 mass % of the solvent A.

Also, the amount of the lubricating oil A may be about 0.3 to 30 mass % with respect to 100 mass % of the solvent A.

(3) Separately from the step (2), the lubricating oil B and the diisocyanate compound are added to the solvent B to obtain a mixed solution B (S12).

At this time, the timing of adding the lubricating oil B and the diisocyanate compound to the solvent B is not particularly limited, and (a) the lubricating oil B may be dissolved in the solvent B to prepare a solution, and then the diisocyanate compound may be dissolved or dispersed in the obtained solution to obtain a mixed solution B;

(b) the diisocyanate compound may be dissolved or dispersed in the solvent B to prepare a mixed solution, and then the lubricating oil B may be dissolved in the obtained mixed solution to obtain a mixed solution B; or (c) the diisocyanate compound and the lubricating oil B may be simultaneously added to the solvent B, and then all the components may be mixed to obtain a mixed solution B.

At this time, the amount of the diisocyanate compound may be about 5 to 60 mass % with respect to 100 mass % of the solvent B.

Also, the amount of the lubricating oil B may be about 0.3 to 30 mass % with respect to 100 mass % of the solvent B.

(4) Next, the mixed solution A and the mixed solution B are mixed, and the amine compound and the diisocyanate compound are reacted to synthesize a diurea compound (S13).

Here, the mixed solution B may be added dropwise to the mixed solution A while the mixed solution A is stirred to mix both solutions, or the mixed solution A may be added dropwise to the mixed solution B while the mixed solution B is stirred to mix both solutions.

The mixed solution A and the mixed solution B may be mixed at room temperature or under heating.

When mixed under heating, the heating temperature may be about 40 to 110° C.

The time for reacting the amine compound and the diisocyanate compound is not particularly limited, and may be any time as long as the reaction proceeds sufficiently. Specifically, for example, the reaction time may be about 0.2 to 5 hours.

In the steps (2) to (4), the mixing of the amine compound, the diisocyanate compound and the lubricating oil into the respective solvents, and the mixing of the mixed solution A and the mixed solution B may be performed using, for example, a mechanical stirrer, a magnet stirrer, or the like. Among them, a mechanical stirrer is preferable from the viewpoint of easily uniformly mixing the components.

Through the steps (1) to (4), a mixture containing the diurea compound (thickener), the lubricating oil A and the lubricating oil B, and the solvent A and the solvent B, that is, the raw material of grease of the present disclosure can be obtained.

(5) The solvent A and the solvent B are removed from the mixture obtained in the step (4) (S14).

The method for removing the solvent A and the solvent B is not particularly limited, and the solvent A and the solvent B may be vaporized at room temperature or while appropriately performing heating, decompression, stirring and the like as necessary. A specific method may be appropriately selected according to the types of the solvent A and the solvent B, and examples thereof include the following methods and the like.

Examples thereof include a method in which the mixture is allowed to stand at room temperature and atmospheric pressure to vaporize the solvent A and the solvent B.

In addition, for example, there is a method of heating the mixture at a temperature lower than the boiling points of the solvent A and the solvent B under atmospheric pressure to vaporize the solvent A and the solvent B. In this case, examples of the heating condition include heating for 5 to 10 hours in a thermostatic bath at 40° C. under atmospheric pressure and the like.

These methods may be combined.

(6) Next, the mixture remaining after removing the solvent A and the solvent B is washed (S15).

By performing this washing step, an unreacted amine compound and diisocyanate compound remaining in the mixture can be removed.

Here, specific examples of the washing method include the following method and the like.

First, the mixture after removing the solvent A and the solvent B is mixed with water and filtered through a membrane filter to recover a residue. Thereafter, the residue is heated at a temperature lower than a boiling point of water and lower than the boiling points of the lubricating oil A and the lubricating oil B to vaporize water attached to the residue, and water is removed from the residue. At this time, examples of the heating condition include heating for 5 to 10 hours in a high-temperature tank at 80° C. under atmospheric pressure and the like.

In the present embodiment, the order of step S14 of removing the solvent A and the solvent B and step S15 of washing the remaining mixture may be reversed.

In this case, for example, the following method or the like can be adopted.

The mixture in which the diurea compound is dispersed in the solvent A and the solvent B is placed in a separating funnel, and water is further placed in the separating funnel to transfer the unreacted amine compound and diisocyanate compound to an aqueous phase. Next, water containing the unreacted amine compound and diisocyanate compound is removed from the separating funnel. Thereafter, the solvent A and the solvent B are removed from the mixture washed using the separating funnel by the method described in step S14 described above.

(7) The washed mixture is recovered to obtain a raw material of grease containing the diurea compound, the lubricating oil A, and the lubricating oil B (S16).

The obtained raw material of grease may be subjected to a pulverization treatment as necessary. By performing the pulverization treatment, the particle diameter of the thickener can be refined and uniformized.

When the pulverization treatment is performed, it is preferable to perform the pulverization treatment by a small pulverizer (for example, Labo Millser manufactured by Osaka Chemical Co., Ltd. or the like) in that the pulverization treatment can be performed at low cost with a simple device.

The raw material of grease produced through the steps (1) to (4) and the raw material of grease produced through the steps (5) to (7) can be used in a method for producing grease described later.

Second Embodiment

Figure 8:
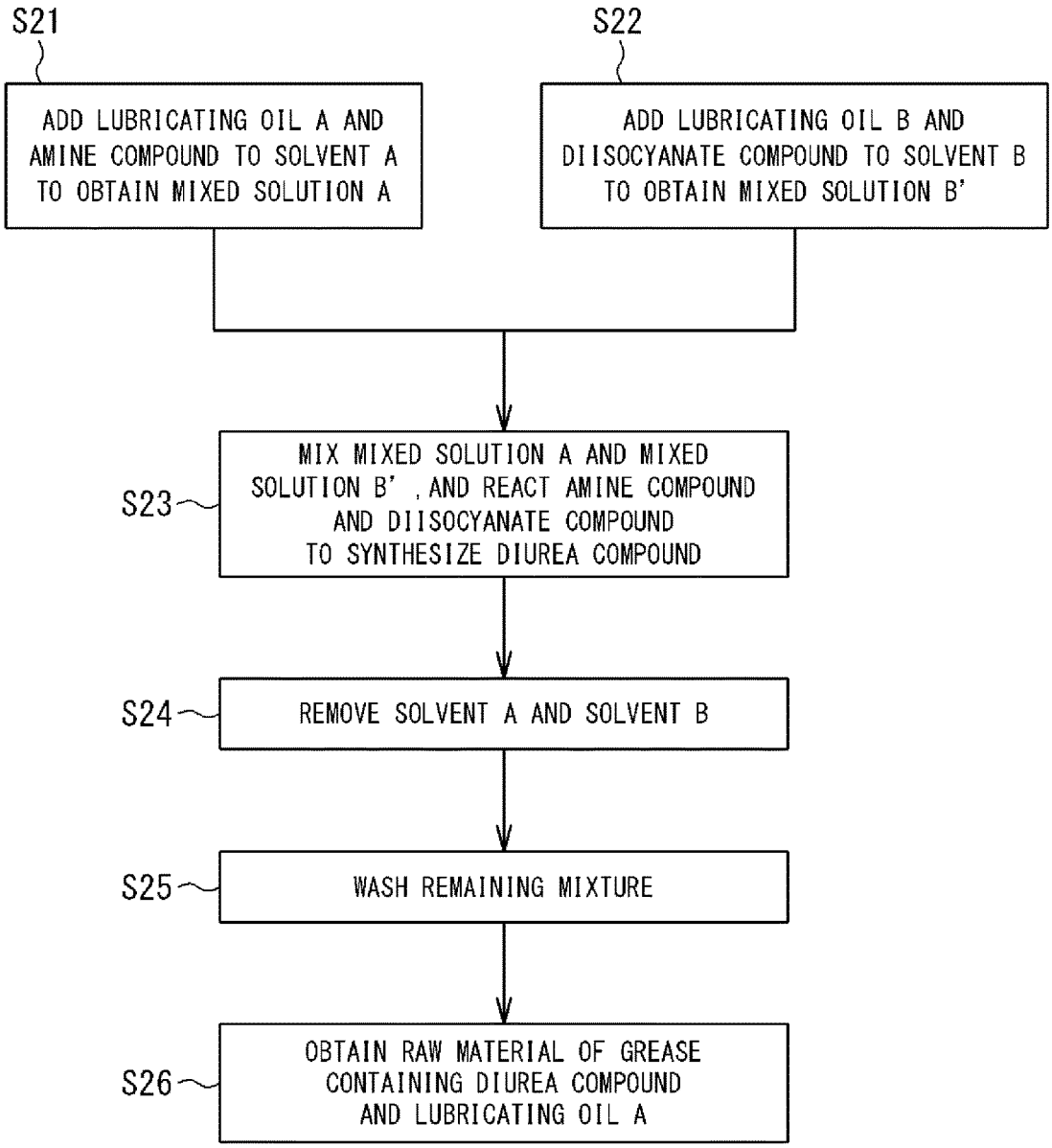
FIG. 8 is a flow chart for explaining a method for producing a raw material of grease of a second embodiment.

FIG. 8 is a flow chart for explaining a method for producing a raw material of grease of a second embodiment.

The method for producing a raw material of grease of the second embodiment is different from that of the first embodiment in the mixed solution containing a diisocyanate compound.

(1) In the present embodiment, first, a predetermined amount of each of an amine compound, a diisocyanate compound, a lubricating oil A, a solvent A, and a solvent B is prepared.

As these components, for example, the same components as those of the first embodiment can be used.

(2) Next, the lubricating oil A and the amine compound are added to the solvent A to obtain a mixed solution A (S21).

This step may be performed in the same manner as step S11 of the first embodiment.

(3) Separately from the step (2), the diisocyanate compound is added to the solvent B to obtain a mixed solution B' (S22).

At this time, the amount of the diisocyanate compound may be about 5 to 60 mass % with respect to 100 mass % of the solvent B.

(4) Next, the mixed solution A and the mixed solution B' are mixed, and the amine compound and the diisocyanate compound are reacted to synthesize a diurea compound (S23).

Here, mixing of the mixed solution A and the mixed solution B' may be performed in the same manner as in step S13 of the first embodiment except that the mixed solution B' is used instead of the mixed solution B.

In the steps (2) to (4), the mixing of the amine compound, the diisocyanate compound, and the lubricating oil into the respective solvents and the mixing of the mixed solution A and the mixed solution B' may be performed using a stirrer as in the first embodiment, and is preferably performed using a mechanical stirrer.

Through the steps (1) to (4), a mixture containing the diurea compound (thickener), the lubricating oil A, and the solvent A and the solvent B, that is, the raw material of grease of the present disclosure can be obtained.

(5) Thereafter, the solvent A and the solvent B are removed (S24), the mixture after removal of the solvent A and the solvent B is washed (S25), and the washed mixture is recovered to obtain a raw material of grease containing the diurea compound and the lubricating oil A (S26), in the same manner as in the first embodiment.

Also in the present embodiment, the order of step S24 of removing the solvent A and the solvent B and step S25 of washing the remaining mixture may be reversed, as in the first embodiment.

Also in the present embodiment, the obtained raw material of grease may be subjected to a pulverization treatment as necessary.

The raw material of grease produced through the steps (1) to (4) and the raw material of grease produced through the step (5) can be used in a method for producing grease described later.

Third Embodiment

Figure 9:
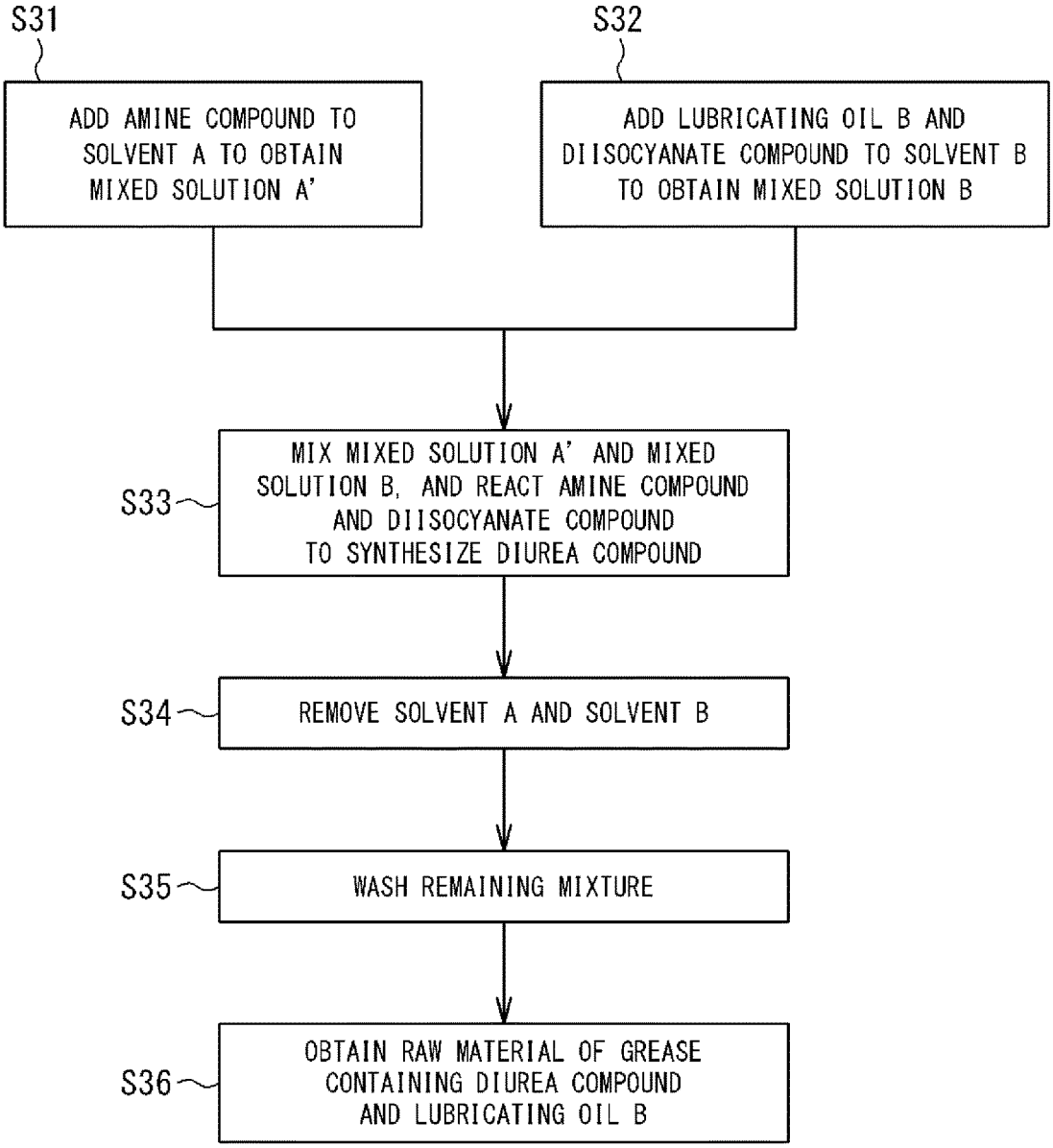
FIG. 9 is a flow chart for explaining a method for producing a raw material of grease of a third embodiment.

FIG. 9 is a flow chart for explaining a method for producing a raw material of grease of a third embodiment.

The method for producing a raw material of grease of the third embodiment is different from that of the first embodiment in the mixed solution containing an amine compound.

(1) In the present embodiment, first, a predetermined amount of each of an amine compound, a diisocyanate compound, a lubricating oil B, a solvent A, and a solvent B is prepared.

As these components, for example, the same components as those of the first embodiment can be used.

(2) Next, the amine compound is added to the solvent A to obtain a mixed solution A' (S31).

At this time, the amount of the amine compound may be about 5 to 60 mass % with respect to 100 mass % of the solvent A.

(3) Next, separately from the step (2), the lubricating oil B and the isocyanate compound are added to the solvent B to obtain a mixed solution B (S32).

This step may be performed in the same manner as step S12 of the first embodiment.

(4) Next, the mixed solution A' and the mixed solution B are mixed, and the amine compound and the diisocyanate compound are reacted to synthesize a diurea compound (S33).

Here, mixing of the mixed solution A' and the mixed solution B may be performed in the same manner as in step S13 of the first embodiment except that the mixed solution A' is used instead of the mixed solution A.

In the steps (2) to (4), the mixing of the amine compound, the diisocyanate compound, and the lubricating oil into the respective solvents and the mixing of the mixed solution A' and the mixed solution B may be performed using a stirrer as in the first embodiment, and is preferably performed using a mechanical stirrer.

Through the steps (1) to (4), a mixture containing the diurea compound (thickener), the lubricating oil B, and the solvent A and the solvent B, that is, the raw material of grease of the present disclosure can be obtained.

(5) Thereafter, the solvent A and the solvent B are removed (S34), the mixture after removal of the solvent A and the solvent B is washed (S35), and the washed mixture is recovered to obtain a raw material of grease containing the diurea compound and the lubricating oil B (S36), in the same manner as in the first embodiment.

Also in the present embodiment, the order of step S34 of removing the solvent A and the solvent B and step S35 of washing the remaining mixture may be reversed, as in the first embodiment.

Also in the present embodiment, the obtained raw material of grease may be subjected to a pulverization treatment as necessary.

The raw material of grease produced through the steps (1) to (4) and the raw material of grease produced through the step (5) can be used in a method for producing grease described later.

Fourth Embodiment

Figure 10:
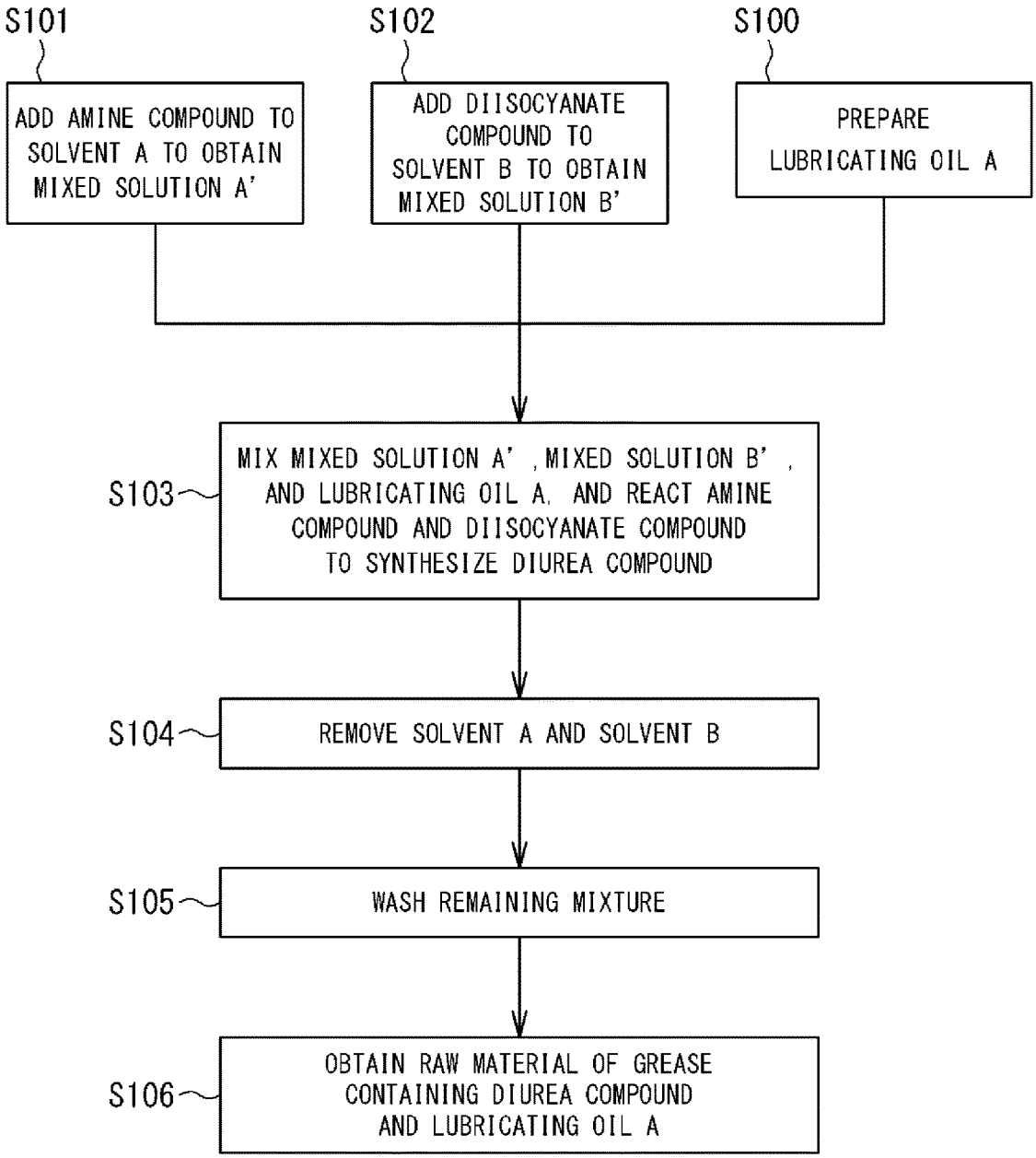
FIG. 10 is a flow chart for explaining a method for producing a raw material of grease of a fourth embodiment.

FIG. 10 is a flow chart for explaining a method for producing a raw material of grease of a fourth embodiment.

The method for producing a raw material of grease of the fourth embodiment is different from those of the first to third embodiments in terms of the timing of adding the lubricating oil A.

(1) In the present embodiment, first, a predetermined amount of each of an amine compound, a diisocyanate compound, a lubricating oil A, a solvent A, and a solvent B is prepared.

As these components, for example, the same components as those of the first embodiment can be used.

(2) Next, the amine compound is added to the solvent A to obtain a mixed solution A' (S101).

This step may be performed in the same manner as step S31 of the third embodiment.

(3) Separately from the step (2), the diisocyanate compound is added to the solvent B to obtain a mixed solution B' (S102).

This step may be performed in the same manner as step S22 of the second embodiment.

(4) Next, the mixed solution A', the mixed solution B' and the lubricating oil A (S100) prepared in advance are mixed, and the amine compound and the diisocyanate compound are reacted to synthesize a diurea compound (S103).

Here, the mixed solution A', the mixed solution B' and the lubricating oil A are simultaneously mixed.

A method of simultaneously mixing the mixed solution A', the mixed solution B' and the lubricating oil A is not particularly limited, and (a) the mixed solution B' and the lubricating oil A may be charged into a container containing the mixed solution A';

(b) the mixed solution A' and the lubricating oil A may be charged into a container containing the mixed solution B';

(c) the mixed solution A' and the mixed solution B' may be charged into a container containing the lubricating oil A; or (d) the mixed solution A', the mixed solution B' and the lubricating oil A may be charged into an empty container.

In the steps (2) to (4), the mixing of the amine compound and the diisocyanate compound into the respective solvents, and the mixing of the mixed solution A', the mixed solution B' and the lubricating oil A may be performed using a stirrer as in the first embodiment, and is preferably performed using a mechanical stirrer.

Through the steps (1) to (4), a mixture containing the diurea compound (thickener), the lubricating oil A, and the solvent A and the solvent B, that is, the raw material of grease of the present disclosure can be obtained.

(5) Thereafter, the solvent A and the solvent B are removed (S104), the mixture after removal of the solvent A and the solvent B is washed (S105), and the washed mixture is recovered to obtain a raw material of grease containing the diurea compound and the lubricating oil A (S106), in the same manner as in the first embodiment.

Also in the present embodiment, the order of step S104 of removing the solvent A and the solvent B and step S105 of washing the remaining mixture may be reversed, as in the first embodiment.

Also in the present embodiment, the obtained raw material of grease may be subjected to a pulverization treatment as necessary.

The raw material of grease produced through the steps (1) to (4) and the raw material of grease produced through the step (5) can be used in a method for producing grease described later.

Fifth Embodiment

Figure 11:
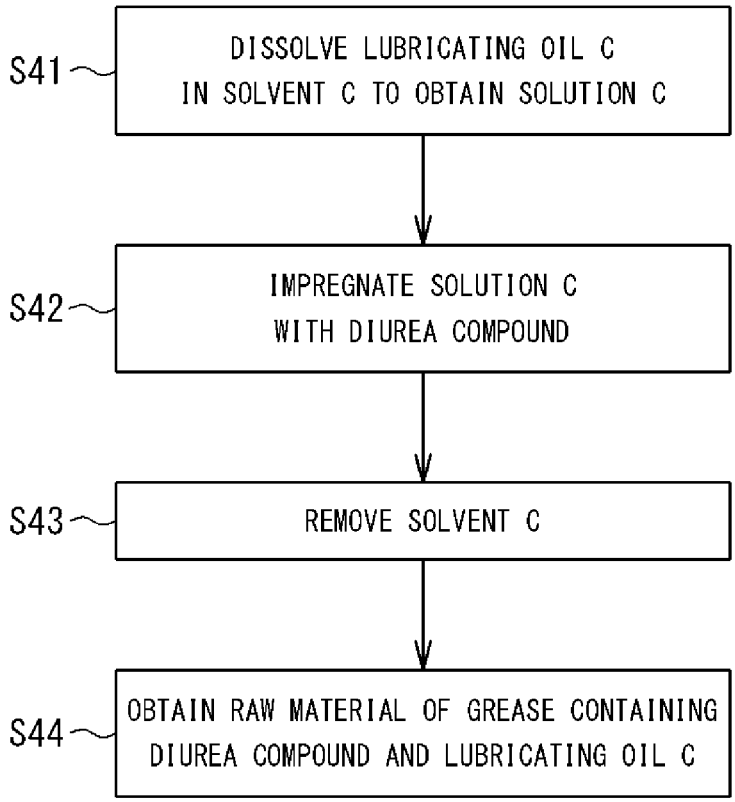
FIG. 11 is a flow chart for explaining a method for producing a raw material of grease of a fifth embodiment.

FIG. 11 is a flow chart for explaining a method for producing a raw material of grease of a fifth embodiment.

The method for producing a raw material of grease of the fifth embodiment is different from those of the first to third embodiments in terms of the timing of coexisting the diurea compound and the lubricating oil.

(1) In the present embodiment, first, a predetermined amount of each of a diurea compound, a lubricating oil C, and a solvent C is prepared.

The diurea compound is a diurea compound known as a thickener for urea-based grease. As the diurea compound, for example, a compound synthesized by reacting an amine compound and a diisocyanate compound in a solvent can be used.

As each of the amine compound and the diisocyanate compound, for example, the same compounds as those in the first embodiment can be used.

The diurea compound may be a commercially available product.

As the lubricating oil C, for example, the same lubricating oil as the lubricating oil A of the first embodiment can be used.

The solvent C may be any solvent that has a boiling point lower than that of the prepared lubricating oil C, dissolves the lubricating oil C, and does not dissolve the diurea compound. For example, the same solvent as the solvent A of the first embodiment can be exemplified.

The viscosity of the solvent C is preferably lower than that of the lubricating oil C.

(2) Next, the lubricating oil C is added to the solvent C to obtain a solution C (S41).

Here, for example, the lubricating oil C may be added dropwise to the solvent C while stirring the solvent C with a stirrer or the like.

At this time, the amount of the lubricating oil C may be about 0.3 to 30 mass % with respect to 100 mass % of the solvent C.

(3) The solution C obtained in the step (2) is impregnated with the diurea compound (S42).

Here, for example, the diurea compound may be added to the solution C little by little while the solution C is put in a container and stirred with a stirrer or the like. Further, for example, the solution C may be added to the diurea compound little by little while the diurea compound is put in a container and stirred with a stirrer or the like.

At this time, the amount of the diurea compound may be about 5 to 60 mass % with respect to 100 mass % of the solvent C.

Through the steps (2) and (3), a mixture containing the diurea compound (thickener), the lubricating oil C and the solvent C, that is, the raw material of grease of the present disclosure can be obtained.

(4) The solvent C is removed from the mixture obtained in the step (3) (S43).

The method for removing the solvent C is not particularly limited, and may be performed by a method similar to the method for removing the solvent A exemplified in the first embodiment or the like in consideration of the boiling point of the solvent C or the like.

(5) The mixture from which the solvent C has been removed is recovered to obtain a raw material of grease containing the diurea compound and the lubricating oil C (S44).

The obtained raw material of grease may be subjected to a pulverization treatment as necessary.

When the pulverization treatment is performed, the pulverization treatment may be performed, for example, by the same method as in the first embodiment.

The raw material of grease produced through the steps (1) to (3) and the raw material of grease produced through the steps (4) to (5) can be used in a method for producing grease described later.

Sixth Embodiment

Figure 12:
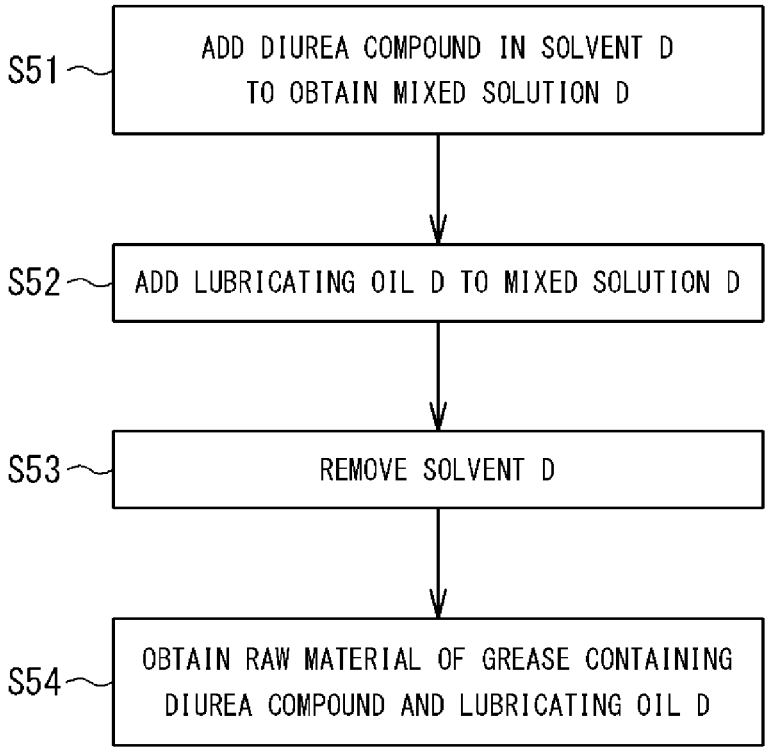
FIG. 12 is a flow chart for explaining a method for producing a raw material of grease of a sixth embodiment.

FIG. 12 is a flow chart for explaining a method for producing a raw material of grease of a sixth embodiment.

The method for producing a raw material of grease of the sixth embodiment is different from that of the fifth embodiment in terms of the timing of coexisting the diurea compound and the solvent.

(1) In the present embodiment, first, a predetermined amount of each of a diurea compound, a lubricating oil D, and a solvent D is prepared.

As the diurea compound, for example, the same compound as that of the fifth embodiment can be used.

Also, the diurea compound may be a commercially available product.

As the lubricating oil D, for example, the same lubricating oil as the lubricating oil A of the first embodiment can be used.

The solvent D may be any solvent that has a boiling point lower than that of the prepared lubricating oil D, dissolves the lubricating oil D, and does not dissolve the diurea compound. For example, the same solvent as the solvent A of the first embodiment can be exemplified.

The viscosity of the solvent D is preferably lower than that of the lubricating oil D.

(2) Next, the diurea compound is added to the solvent D to obtain a mixed solution D (S51).

Here, for example, the diurea compound may be added dropwise to the solvent D while stirring the solvent D with a stirrer or the like.

At this time, the amount of the diurea compound may be about 5 to 60 mass % with respect to 100 mass % of the solvent D.

(3) The lubricating oil D is added to the mixed solution D obtained in the step (2) (S52).

Here, for example, the lubricating oil D may be added dropwise to the mixed solution D while the mixed solution D is placed in a container and stirred with a stirrer or the like. Conversely, while the lubricating oil D is placed in a container and stirred with a stirrer or the like, the mixed solution D may be added dropwise to the lubricating oil D.

At this time, the amount of the lubricating oil D may be about 0.3 to 30 mass % with respect to 100 mass % of the solvent D.

Through the steps (2) and (3), a mixture containing the diurea compound (thickener), the lubricating oil D and the solvent D, that is, the raw material of grease of the present disclosure can be obtained.

(4) The solvent D is removed from the mixture obtained in the step (3) (S53).

The method for removing the solvent D is not particularly limited, and may be performed by a method similar to the method for removing the solvent A exemplified in the first embodiment or the like in consideration of the boiling point of the solvent D or the like.

(5) The mixture from which the solvent D has been removed is recovered to obtain a raw material of grease containing the diurea compound and the lubricating oil D (S54).

The obtained raw material of grease may be subjected to a pulverization treatment as necessary.

When the pulverization treatment is performed, the pulverization treatment may be performed, for example, by the same method as in the first embodiment.

The raw material of grease produced through the steps (1) to (3) and the raw material of grease produced through the steps (4) to (5) can be used in a method for producing grease described later.

According to the first to sixth embodiments described above, the raw material of grease of the present disclosure can be produced.

Next, a method for producing grease using the raw material of grease will be described.

Seventh Embodiment

Figure 13:
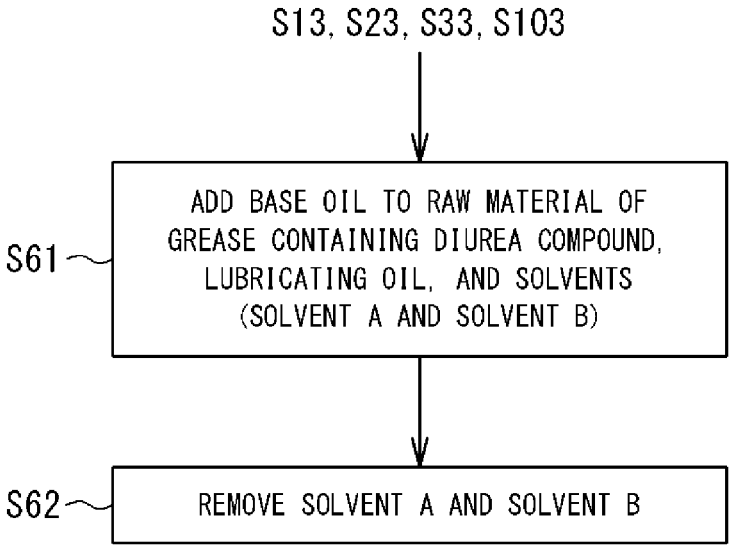
FIG. 13 is a flow chart for explaining a method for producing grease of a seventh embodiment.

FIG. 13 is a flow chart for explaining a method for producing grease of a seventh embodiment.

(1) In the method for producing grease of the present embodiment, first, a base oil is added to a raw material of grease (S13 of the first embodiment, S23 of the second embodiment, S33 of the third embodiment, and S103 of the fourth embodiment) containing the diurea compound (thickener), the lubricating oil A and/or the lubricating oil B, and the solvent A and the solvent B, produced in the first to fourth embodiments, and both are mixed (S61).

As the base oil, a conventionally known lubricating oil used as a base oil of grease can be used. Specific examples thereof include ether oil such as alkyl diphenyl ether (ADE), ester oil, poly-α-olefin (PAO), polyalkylene glycol, fluorine oil, silicone oil, mineral oil, and the like. One kind of the base oil may be used alone, or two or more kinds thereof may be used in combination.

The base oil used in this step may be the same as or different from the lubricating oil contained in the raw material of grease.

As the base oil, poly-α-olefin (PAO) or a trimellitic acid ester which is one kind of ester oil is preferable. The base oil is more preferably a trimellitic acid ester from the viewpoint of ensuring good wear resistance while ensuring oil retention.

The poly-α-olefin (PAO) is preferably PAO6 or PAO8.

As the trimellitic acid ester, a trimellitic acid triester is preferable.

Examples of the trimellitic acid triester include a reaction product of trimellitic acid and a monoalcohol having 6 to 18 carbon atoms. Among them, a reaction product of trimellitic acid and a monoalcohol having 8 and/or 10 carbon atoms is preferable.

Specific examples of the trimellitic acid triester include tri 2-ethylhexyl trimellitic acid, trinormal alkyl (C8,C10) trimellitic acid, triisodecyl trimellitic acid, trinormal octyl trimellitic acid, and the like.

The trimellitic acid triester preferably has a base oil kinematic viscosity at 40° C. of 37 to 57 $mm^2/s$.

The base oil kinematic viscosity is a value in accordance with JIS K 2283: 2000.

Here, the raw material of grease may be added dropwise to the base oil while stirring the base oil to mix both, or the base oil may be added dropwise to the raw material of grease while stirring the raw material of grease to mix both.

It is preferable that the raw material of grease and the base oil are mixed under heating. At this time, the heating temperature may be about 130 to 180° C.

The mixing time of the raw material of grease and the base oil is not particularly limited, and may be, for example, about 0.5 to 2 hours.

The method of mixing the raw material of grease and the base oil is not particularly limited as long as they are uniformly mixed, and examples thereof include a method using a mechanical stirrer or a magnet stirrer, and the like.

Among them, the method using a mechanical stirrer is preferable from the viewpoint of easily uniformly mixing both.

(2) The solvent A and the solvent B are removed from the mixture obtained in the step (1) (S62).

The method for removing the solvent A and the solvent B is not particularly limited, and the solvent A and the solvent B may be vaporized at room temperature or while appropriately performing heating, decompression, stirring and the like as necessary. A specific method may be appropriately selected according to the types of the solvent A and the solvent B, and examples thereof include the following methods, and the like.

Examples thereof include a method in which the mixture is allowed to stand at room temperature and atmospheric pressure to vaporize the solvent A and the solvent B.

In addition, for example, there is a method of heating the mixture at a temperature lower than the boiling points of the solvent A and the solvent B under atmospheric pressure to vaporize the solvent A and the solvent B. In this case, examples of the heating condition include heating for 5 to 10 hours in a thermostatic bath at 40° C. under atmospheric pressure and the like.

These methods may be combined.

Grease containing a diurea compound (thickener) and a base oil can be produced through the steps (1) and (2).

In the present embodiment, after the solvent A and the solvent B are removed in the step (2), a homogenization treatment using a roll mill or the like may be performed as necessary.

Also, in the case of producing grease containing an additive, for example, the solvent A and the solvent B are removed, and then a necessary additive may be mixed.

Eighth Embodiment

Figure 14:
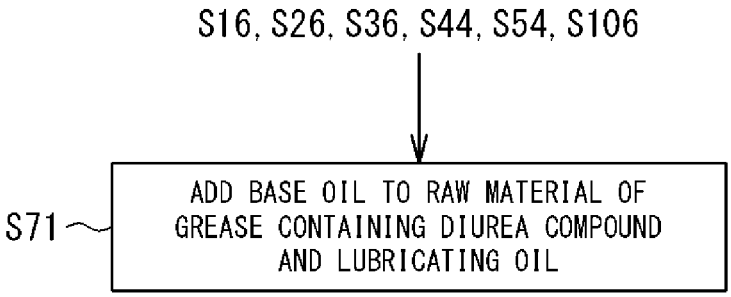
FIG. 14 is a flow chart for explaining a method for producing grease of an eighth embodiment.

FIG. 14 is a flow chart for explaining a method for producing grease of an eighth embodiment.

(1) In the method for producing grease of the present embodiment, a base oil is added to a raw material of grease (S16 of the first embodiment, S26 of the second embodiment, S36 of the third embodiment, S106 in the fourth embodiment, S44 of the fifth embodiment, and S54 of the sixth embodiment) containing the diurea compound (thickener) and the lubricating oil A and/or the lubricating oil B, the lubricating oil C, or the lubricating oil D, produced in the first to sixth embodiments, and both are mixed (S71).

Examples of the base oil include those similar to the base oil exemplified in the seventh embodiment.

The base oil used in this step may be the same as or different from the lubricating oil contained in the raw material of grease.

Here, the raw material of grease may be added dropwise to the base oil while stirring the base oil to mix both, or the base oil may be added dropwise to the raw material of grease while stirring the raw material of grease to mix both.

It is preferable that the raw material of grease and the base oil are mixed under heating. At this time, the heating temperature may be about 130 to 180° C.

The mixing time of the raw material of grease and the base oil is not particularly limited, and may be, for example, about 0.5 to 2 hours.

The method of mixing the raw material of grease and the base oil is not particularly limited as long as they are uniformly mixed, and examples thereof include a method using a mechanical stirrer or a magnet stirrer, and the like. Among them, the method using a mechanical stirrer is preferable from the viewpoint of easily uniformly mixing both.

In the present embodiment, since the raw material of the grease after the solvent is removed is mixed with the base oil, the grease containing the diurea compound (thickener) and the base oil can be produced through the step (1).

In the present embodiment, after the raw material of grease and the base oil are mixed, a homogenization treatment using a roll mill or the like may be performed as necessary.

Also, in the case of producing grease containing an additive, for example, the raw material of grease and the base oil may be mixed, and then a necessary additive may be mixed.

Ninth Embodiment

Figure 15:
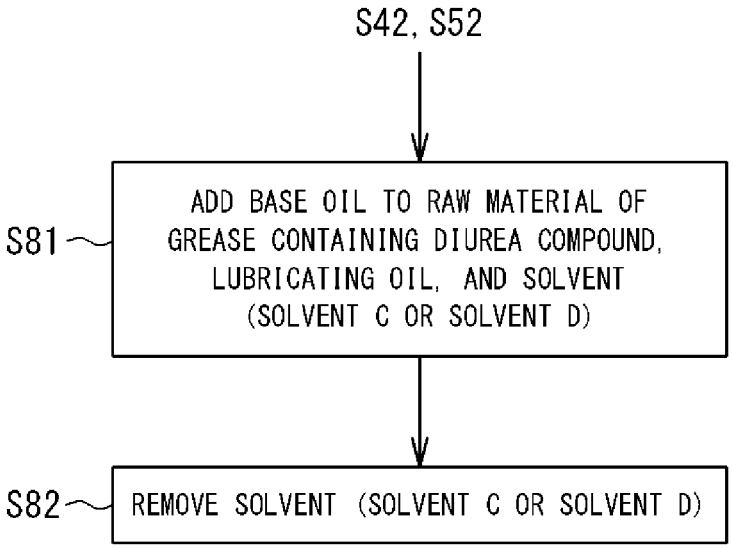
FIG. 15 is a flow chart for explaining a method for producing grease of a ninth embodiment.

FIG. 15 is a flow chart for explaining a method for producing grease of a ninth embodiment.

(1) In the method for producing grease of the present embodiment, a base oil is added to a raw material of grease (S42 of the fifth embodiment and S52 of the sixth embodiment) containing the diurea compound (thickener) produced in the fifth to sixth embodiments and the lubricating oil C and the solvent C or the lubricating oil D and the solvent D, and both are mixed (S81).

Examples of the base oil include those similar to the base oil exemplified in the seventh embodiment.

The base oil used in this step may be the same as or different from the lubricating oil contained in the raw material of grease.

Here, the raw material of grease may be added dropwise to the base oil while stirring the base oil to mix both, or the base oil may be added dropwise to the raw material of grease while stirring the raw material of grease to mix both.

It is preferable that the raw material of grease and the base oil are mixed under heating. At this time, the heating temperature may be about 130 to 180° C.

The mixing time of the raw material of grease and the base oil is not particularly limited, and may be, for example, about 0.5 to 2 hours.

The method of mixing the raw material of grease and the base oil is not particularly limited as long as they are uniformly mixed, and examples thereof include a method using a mechanical stirrer or a magnet stirrer, and the like. Among them, the method using a mechanical stirrer is preferable from the viewpoint of easily uniformly mixing both.

(2) The solvent C or the solvent D is removed from the mixture obtained in the step (1) (S82).

Here, the method for removing the solvent C or the solvent D is not particularly limited, and for example, a method similar to the method for removing the solvent A and the solvent B in the seventh embodiment can be used. A specific method may be appropriately selected according to the types of the solvent C and the solvent D to be removed, and examples thereof include the following methods, and the like.

Examples thereof include a method in which the mixture is allowed to stand at room temperature and atmospheric pressure to vaporize the solvent C (or the solvent D).

In addition, for example, there is a method of heating the mixture at a temperature lower than the boiling point of the solvent C (or the solvent D) under atmospheric pressure to vaporize the solvent C (or the solvent D). In this case, examples of the heating condition include heating for 5 to 10 hours in a thermostatic bath at 40° C. under atmospheric pressure and the like.

These methods may be combined.

Grease containing a diurea compound (thickener) and a base oil can be produced through the steps (1) and (2).

In the present embodiment, after the solvent C or the solvent D is removed in the step (2), a homogenization treatment using a roll mill or the like may be performed as necessary.

Also, in the case of producing grease containing an additive, for example, the solvent C or the solvent D are removed, and then a necessary additive may be mixed.

According to the methods for producing grease of the seventh to ninth embodiments, it is possible to provide grease having ensured oil retention.

In the method for producing grease, a raw material of grease containing a lubricating oil in a thickener is mixed with a base oil to produce grease. Therefore, it is considered that the affinity between the thickener (the raw material of grease) and the base oil is improved, and the oil retention of the obtained grease is ensured.

Also, in the method for producing grease, it is considered that when the raw material of grease and the base oil are mixed, the lubricating oil contained in the thickener is attracted to the base oil to crush the thickener powder, so that the thickener is refined, and this is also considered to be one of the reasons for improving the oil retention of the produced grease. In addition, it is considered that as the thickener is refined, seizure resistance and wear resistance are easily ensured.

The grease produced in the embodiment of the present disclosure can be used as, for example, grease sealed in a gear such as an electric power steering gear of an automobile, a rolling bearing, or the like.

Tenth Embodiment

The grease according to an embodiment of the present disclosure includes a thickener, a base oil, and an additive, in which the thickener is a diurea compound;

the base oil is poly-α-olefin and a trimellitic acid ester; and an amount of the thickener is 20.0 to 40.0 mass %, an amount of the poly-α-olefin is 0.1 to 5.0 mass %, and an amount of the trimellitic acid ester is 59.9 to 75 mass %, with respect to the total amount of the thickener and the base oil.

The grease of the present embodiment has good oil retention and is excellent in wear resistance when used for a rolling bearing, a gear, and the like.

Each of the diurea compound, the poly-α-olefin and the trimellitic acid ester is not particularly limited, and is the same as that employed in the first to ninth embodiments.

The additive is not particularly limited, and may be any conventionally known additive contained in the grease.

Examples of the additive include a rust preventive, an antioxidant, an extreme pressure agent, an oily agent, an anti-wear agent, a dye, a hue stabilizer, a thickening agent, a structure stabilizer, a metal deactivator, a viscosity index improver, and the like.

In the grease, the amount of the thickener is 20.0 to 40.0 mass %, the amount of the poly-α-olefin is 0.1 to 5.0 mass %, and the amount of the trimellitic acid ester is 59.9 to 75 mass %, with respect to the total amount of the thickener and the base oil, and thus, the above-described effects are exhibited.

The total content of the additive is, for example, about 1 to 20 mass % with respect to the total amount of the thickener and the base oil.

The grease can be suitably produced by the methods for producing grease of the seventh to ninth embodiments.

Other Embodiments

In the first to tenth embodiments, the thickener is a diurea compound, but in the embodiment of the present disclosure, the thickener is not limited to a diurea compound, and may be a monourea compound or a polyurea compound such as a triurea compound or a tetraurea compound.

As described above, even when the thickener is a urea-based thickener other than a diurea compound, the present disclosure can be implemented by selecting an amine compound as one of the first thickener raw material and the second thickener raw material and selecting a diisocyanate compound as the other.

In the embodiment of the present disclosure, the thickener is not limited to a urea-based thickener, and may be other thickener.

Examples of other thickener include soap-based thickeners such as lithium soap, calcium soap, and lithium composite soap.

When the thickener is a lithium soap, for example, a fatty acid may be selected as one of the first thickener raw material and the second thickener raw material, and lithium hydroxide may be selected as the other.

When the thickener is a calcium soap, for example, a fatty acid may be selected as one of the first thickener raw material and the second thickener raw material, and calcium hydroxide may be selected as the other.

When the thickener is a lithium composite soap, for example, a fatty acid and an organic acid different from the fatty acid may be selected as one of the first thickener raw material and the second thickener raw material, and lithium hydroxide may be selected as the other.

EXAMPLES

Next, the invention of the present disclosure will be described in more detail based on examples, but the invention of the present disclosure is not limited to only the examples.

In Examples/Comparative Examples, the following raw materials were used.

Diisocyanate compound: 4,4'-diphenylmethane diisocyanate (MDI)

Amine compound: octylamine

Base oil (lubricating oil): poly-α-olefin: PAO6 (base oil kinematic viscosity at 40° C. is 30.5 $mm^2/s$)

Base oil (lubricating oil): poly-α-olefin: PAO8 (base oil kinematic viscosity at 40° C. is 46 $mm^2/s$)

Base oil (lubricating oil): trimellitic acid ester: TRIMEX N-08 (manufactured by Kao Corporation)

Solvent: toluene

Example 1

(1) In 100 mass % of toluene, 9 mass % of PAO8 was dissolved as a lubricating oil coexisting during synthesis.

Furthermore, a predetermined amount of octylamine was mixed with the obtained solution to obtain a mixed solution A1.

(2) Separately from the step (1), a predetermined amount of MDI was mixed with a solution in which 1 mass % of PAO8 was dissolved in 100 mass % of toluene as a lubricating oil coexisting during synthesis to obtain a mixed solution B1.

In the steps (1) and (2), the amounts of the octylamine and the MDI were set such that the compounding ratio (octylamine:MDI) of both was 2:1 in terms of molar ratio, and the amount of the diurea compound produced was 30.0 mass % with respect to 100 mass % of toluene.

The mixed solution A1 was prepared by adding PAO8 and octylamine while stirring toluene with a mechanical stirrer.

Also, the mixed solution B1 was prepared by adding PAO8 and MDI while stirring toluene with a mechanical stirrer.

(3) While the mixed solution B1 was stirred with a mechanical stirrer, the mixed solution A1 was added dropwise to the mixed solution B1, and both were mixed.

After the completion of dropwise addition of the mixed solution A1, octylamine and MDI were reacted at room temperature while continuing stirring for 0.5 hours to produce a diurea compound.

(4) Thereafter, the mixture containing a diurea compound, PAO8 and toluene was allowed to stand at room temperature for 24 hours, and toluene was removed by evaporation. Further, pulverization was performed using Labo Millser manufactured by Osaka Chemical Co., Ltd. to produce a raw material of grease.

(5) The raw material of grease at room temperature was charged into PAO8 as a base oil at room temperature, and heated to 150° C. while being stirred with a mechanical stirrer. The base oil mixed with the raw material of grease was continuously stirred with a mechanical stirrer for 1 hour while being maintained at 150° C. Thereafter, the mixture was cooled to room temperature while being continuously stirred with a mechanical stirrer, and stirring was stopped.

At this time, the amount of the raw material of grease was set to 24.7 mass % with respect to the total amount of the base oil and the raw material of grease.

Thereafter, a homogenization treatment using a roll mill was performed to complete grease.

Comparative Example 1

(1) A predetermined amount of octylamine was mixed with toluene to obtain a mixed solution A2'.

(2) Separately from the step (1), a predetermined amount of MDI was mixed with toluene to obtain a mixed solution B2'.

In the steps (1) and (2), the amounts of the octylamine and the MDI were set such that the compounding ratio (octylamine:MDI) of both was 2:1 in terms of molar ratio, and the amount of the diurea compound produced was 30.0 mass % with respect to 100 mass % of toluene.

The mixed solution A2' was prepared by adding octylamine while stirring toluene with a mechanical stirrer.

The mixed solution B2' was prepared by adding MDI while stirring toluene with a mechanical stirrer.

(3) While the mixed solution B2' was stirred with a mechanical stirrer, the mixed solution A2' was added dropwise to the mixed solution B2', and both were mixed.

After the completion of dropwise addition of the mixed solution A2', octylamine and MDI were reacted at room temperature while continuously stirring for 0.5 hours to produce a diurea compound.

(4) Thereafter, the mixture containing the diurea compound and toluene was allowed to stand at room temperature for 24 hours, and toluene was removed by evaporation. Further, pulverization was performed using Labo Millser manufactured by Osaka Chemical Co., Ltd. to produce a raw material of grease.

(5) The raw material of grease at room temperature was charged into PAO8 as a base oil at room temperature, and heated to 150° C. while being stirred with a mechanical stirrer. The base oil mixed with the raw material of grease was continuously stirred with a mechanical stirrer for 1 hour while being maintained at 150° C. Thereafter, the mixture was cooled to room temperature while being continuously stirred with a mechanical stirrer, and stirring was stopped.

At this time, the amount of the raw material of grease was set to 34.5 mass % with respect to the total amount of the base oil and the raw material of grease.

Thereafter, a homogenization treatment using a roll mill was performed to complete grease.

The following evaluations were performed for Example 1 and Comparative Example 1.

1. Measurement of Average Particle Diameter

The average particle diameter of the thickener (diurea compound) was measured for the raw material of grease produced in Example 1 and the raw material of grease produced in Comparative Example 1. The results are shown in Table 2.

The average particle diameter was measured using a confocal laser microscope TCS SP8 manufactured by Leica Microsystems.

2. Mixing Consistency (60 W)

For the grease produced in Example 1 and the grease produced in Comparative Example 1, the mixing consistency (60 W) was measured by a method in accordance with JIS K 2220: 2013. The results are shown in Table 2.

3. Seizure Limit Load

For the grease produced in Example 1 and the grease produced in Comparative Example 1, the seizure limit load was measured by the following method. The results are shown in Table 2.

The seizure limit load was measured by a reciprocating sliding test using SRVII tester manufactured by PERKER NETSUSHORI KOGYO CO., LTD. Details of the measurement conditions are as shown in Table 1.

TABLE 1

| Item | Condition |
|---|---|
| Test piece material | SUJ2 |
| Frequency | 50 Hz |
| Amplitude | 1.5 mm |
| Test temperature | 25° C., 100° C. |
| Test piece shape | Steel ball: 10 mm |
| Tester | SRVII |

4. Oil Separation

Figure 16:
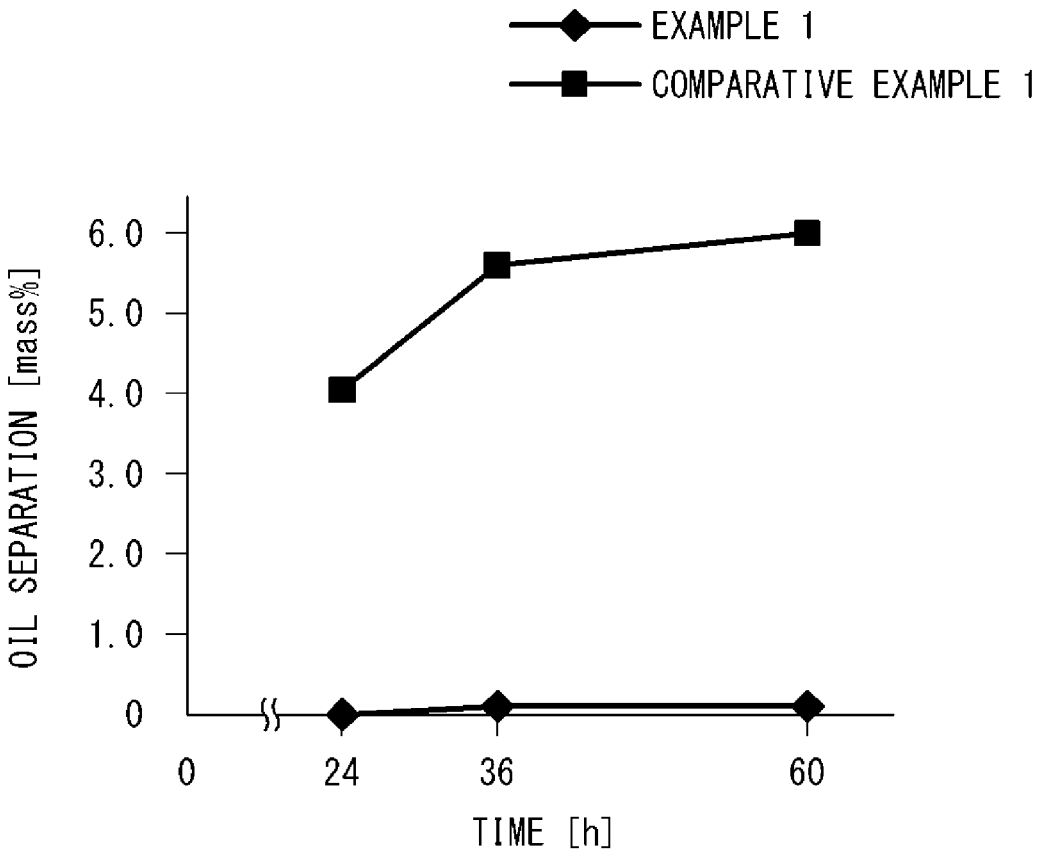
FIG. 16 is a graph showing evaluation results of oil separation of grease produced in Example 1 and Comparative Example 1.

For the grease produced in Example 1 and the grease produced in Comparative Example 1, the oil separation was measured by a method in accordance with JIS K 2220: 2013. The results are shown in Table 2 and FIG. 16.

At this time, the test temperature was set to 100° C., and the oil separation after elapse of 24 hours, 36 hours, and 60 hours was measured.

TABLE 2

| | | Unit | Example 1 | Comparative Example 1 |
|---|---|---|---|---|
| Raw material of grease (thickener) | Synthesis environment | — | In solvent | In solvent |
| | Lubricating oil coexisting during synthesis | — | PAO8 | — |
| Grease | Type of base oil | — | PAO8 | PAO8 |
| | Amount of thickener (raw material of grease) | mass % | 24.7 | 34.5 |
| Raw material of grease | Average particle diameter | μm | 0.26 | 0.89 |
| Grease | Mixing consistency (60 W) | — | 262 | 266 |
| | Oil separation (100° C., 24 hr) | mass % | 0.00 | 4.20 |
| | Seizure limit load 25° C. | N | 20 | 0 |
| | 100° C. | N | 50 | 20 |

As shown in Table 2, it has become clear that grease having good oil retention and seizure resistance can be produced, according to the invention of the present disclosure.

Example 2

(1) In 100 mass % of toluene, 1 mass % of PAO8 was dissolved as a lubricating oil coexisting during synthesis. Furthermore, a predetermined amount of octylamine was mixed with the obtained solution to obtain a mixed solution A3.

(2) Separately from the step (1), a predetermined amount of MDI was mixed with 100 mass % of toluene to obtain a mixed solution B3'.

In the steps (1) and (2), the amounts of the octylamine and the MDI were set such that the compounding ratio (octylamine:MDI) of both was 2:1 in terms of molar ratio, and the amount of the diurea compound produced was 30.0 mass % with respect to 100 mass % of toluene.

The mixed solution A3 was prepared by adding PAO8 and octylamine while stirring toluene with a mechanical stirrer.

Also, the mixed solution B3' was prepared by adding MDI while stirring toluene with a mechanical stirrer.

(3) While the mixed solution B3' was stirred with a mechanical stirrer, the mixed solution A3 was added dropwise to the mixed solution B3', and both were mixed.

After the completion of dropwise addition of the mixed solution A3, octylamine and MDI were reacted at room temperature while continuing stirring for 0.5 hours to produce a diurea compound.

(4) Thereafter, the mixture containing a diurea compound, PAO8 and toluene was allowed to stand at room temperature for 24 hours, and toluene was removed by evaporation. Further, pulverization was performed using Labo Millser manufactured by Osaka Chemical Co., Ltd. to produce a raw material of grease.

(5) The raw material of grease at room temperature was charged into a trimellitic acid ester as a base oil at room temperature, and heated to 150° C. while being stirred with a mechanical stirrer. The base oil mixed with the raw material of grease was continuously stirred with a mechanical stirrer for 1 hour while being maintained at 150° C. Thereafter, the mixture was cooled to room temperature while being continuously stirred with a mechanical stirrer, and stirring was stopped.

At this time, the amount of the raw material of grease was 34.6 mass % with respect to the total amount of the base oil and the raw material of grease.

Thereafter, a homogenization treatment using a roll mill was performed to complete grease.

Example 3

Grease was produced in the same manner as in Example 2, except that PAO6 was used as a lubricating oil coexisting during synthesis in place of PAO8 in (1) of Example 2, and the amount of the raw material of grease to be charged in (5) of Example 2 was 33.8 mass % with respect to the total amount of the base oil and the raw material of grease.

Comparative Example 2

Grease containing a trimellitic acid ester as a base oil and diurea as a thickener was prepared through the following steps.

(1) A trimellitic acid ester is used as a base oil, and this base oil is heated to 100° C.

(2) The base oil, octylamine and 4,4'-diphenylmethane diisocyanate (MDI) are weighed.

(3) Half of the base oil (100° C.) and MDI are charged into a container A, and the mixture is stirred at 100° C. for 30 minutes.

(4) The remaining half of the base oil (100° C.) and octylamine are charged into a container B, and the mixture is stirred at 100° C. for 30 minutes.

(5) The amine solution in the container B is added dropwise to the container A and gradually added to the isocyanate solution.

(6) After confirming that the entire amount of the amine solution in the container B has been charged into the container A, the temperature is raised to 170° C.

(7) The mixture is stirred while heating, and the temperature is hold at 170° C. for 30 minutes.

(8) The heating is stopped, and the mixture is naturally cooled with stirring, and cooled to 100° C.

(9) After confirming that the temperature has reached 100° C. or lower, the stirring is stopped, and the mixture is naturally cooled until the temperature reaches normal temperature.

(10) A homogenization treatment is performed with a roll mill.

Grease was completed through such steps (1) to (10).

The amount of the thickener for grease is 32.0 mass with respect to the total amount of the base oil and the thickener.

Example 4

(1) A raw material of grease was produced in the same manner as in (1) to (4) of Example 2.

(2) The raw material of grease at room temperature was charged into PAO6 as a base oil at room temperature, and heated to 150° C. while being stirred with a mechanical stirrer. The base oil mixed with the raw material of grease was continuously stirred with a mechanical stirrer for 1 hour while being maintained at 150° C. Thereafter, the mixture was cooled to room temperature while being continuously stirred with a mechanical stirrer, and stirring was stopped.

At this time, the amount of the raw material of grease was 33.2 mass % with respect to the total amount of the base oil and the raw material of grease.

Thereafter, a homogenization treatment using a roll mill was performed to complete grease.

Example 5

(1) A raw material of grease was produced in the same manner as in (1) to (4) of Example 2 except that 1 mass % of trimellitic acid ester was used as a lubricating oil coexisting during synthesis in place of 1 mass % of PAO8 in (1) of Example 2.

(2) The raw material of grease at room temperature was charged into PAO8 as a base oil at room temperature, and heated to 150° C. while being stirred with a mechanical stirrer. The base oil mixed with the raw material of grease was continuously stirred with a mechanical stirrer for 1 hour while being maintained at 150° C. Thereafter, the mixture was cooled to room temperature while being continuously stirred with a mechanical stirrer, and stirring was stopped.

At this time, the amount of the raw material of grease was 30.8 mass % with respect to the total amount of the base oil and the raw material of grease.

Thereafter, a homogenization treatment using a roll mill was performed to complete grease.

Comparative Example 3

Grease was produced in the same manner as in Comparative Example 2 except that PAO8 was used as the base oil in place of trimellitic acid ester.

The amount of the thickener for grease was set to 33.5 mass with respect to the total amount of the base oil and the thickener.

The following evaluations were performed for Examples 2 to 5 and Comparative Examples 2 to 3.

1. Measurement of Average Particle Diameter

For the raw materials of grease produced in Examples 2 to 5, the average particle diameter of the thickener (diurea compound) was measured in the same manner as the method employed in Example 1 described above. The results are shown in Table 4.

2. Mixing Consistency (60 W)

For the grease produced in Examples 2 to 5 and the grease produced in Comparative Examples 2 to 3, the mixing consistency (60 W) was measured by a method in accordance with JIS K 2220: 2013. The results are shown in Table 4.

4. Oil Separation

For the grease produced in Examples 2 to 5, the oil separation was measured by a method in accordance with JIS K 2220: 2013. The results are shown in Table 4.

At this time, the test temperature was set to 100° C., and the oil separation after elapse of 24 hours was measured.

5. Friction and Wear Test

The grease produced in Examples 2 to 5 and the grease produced in Comparative Examples 2 to 3 were subjected to a ball-on-disk friction and wear test using a friction and wear tester (friction player FPR2100 manufactured by RHESCA Co., LTD.) to evaluate the wear amount (steel ball wear mark area).

Here, the grease was applied onto the side surface of a bearing washer (shaft bearing washer or housing bearing washer) made of SUJ2, and a load was applied thereon so that the contact surface pressure was 2.4 GPa, and a steel ball made of SUJ2 was brought into contact therewith.

In this state, the bearing washer was rotated for 1800 seconds, and then, the wear mark area ($mm^2$) of the steel ball was measured as the wear amount. Details of the test conditions are as shown in Table 3.

Figure 17:
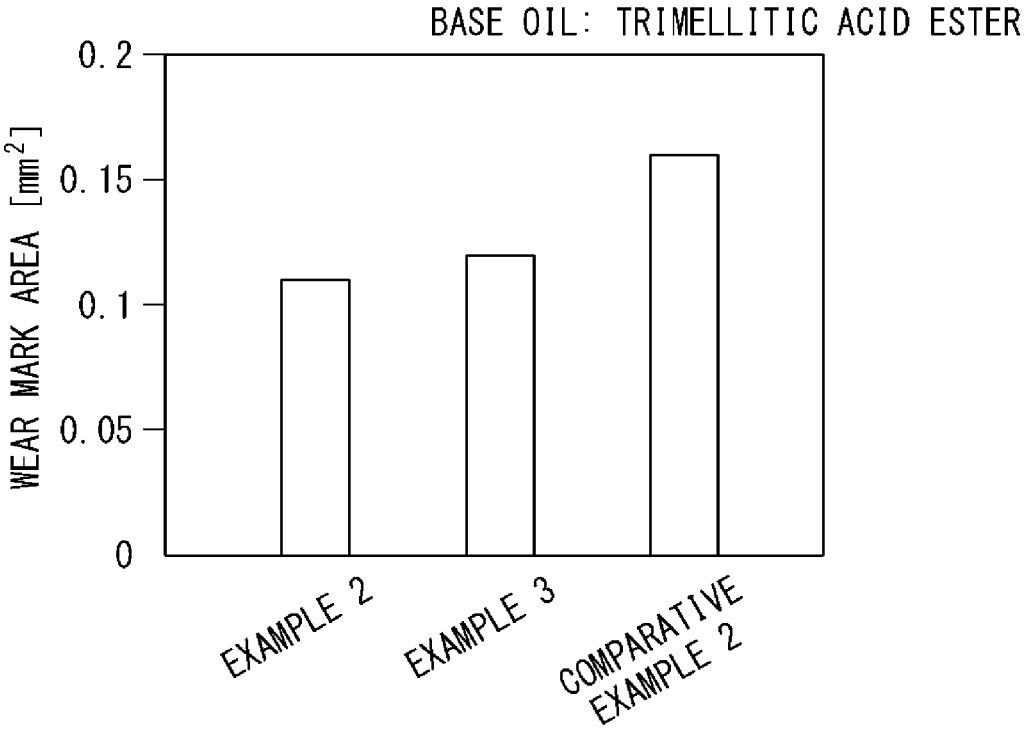
FIG. 17 is a graph showing evaluation results of friction and wear test of grease produced in Examples 2 and 3 and Comparative Example 2.
Figure 18:
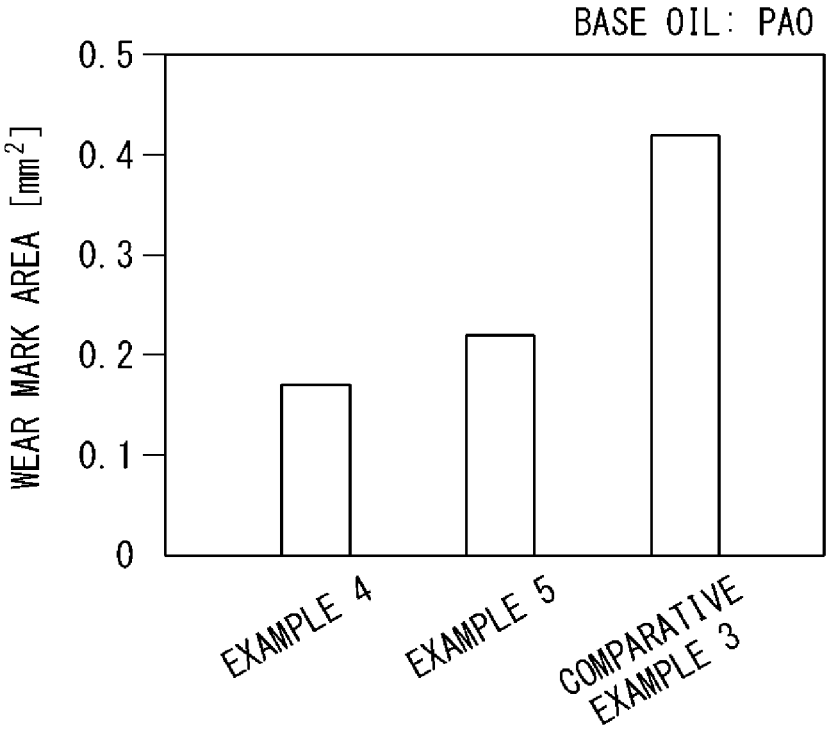
FIG. 18 is a graph showing evaluation results of friction and wear test of grease produced in Examples 4 and 5 and Comparative Example 3.

The results are shown in Table 4 and FIGS. 17 and 18. FIG. 17 shows the results of grease using a trimellitic acid ester as a base oil, and FIG. 18 shows the results of grease using PAO (poly-α-olefin) as a base oil.

TABLE 3

| Item | Condition |
|---|---|
| Test piece material | SUJ2 |
| Load | 30N |
| Peripheral speed | 200 mm/s |
| Test temperature | 100° C. |
| Test time | 1800 s |
| Test piece shape | Steel ball: 3/16 inches |
| Evaluation item | Wear mark area of steel ball ($mm^2$) |
| Tester | Friction player FRP-2100 (RHESCA)s |

TABLE 4

| | | Unit | Example 2 | Example 3 | Comparative Example 2 | Example 4 | Example 5 | Comparative Example 3 |
|---|---|---|---|---|---|---|---|---|
| Raw material of grease (thickener) | Synthesis environment | — | In solvent | In solvent | In base oil | In solvent | In solvent | In base oil |
| | Lubricating oil coexisting during synthesis | — | PAO8 | PAO6 | — | PAO8 | Trimellitic acid ester | — |
| Grease | Type of base oil | — | Trimellitic acid ester | Trimellitic acid ester | Trimellitic acid ester | PAO6 | PAO8 | PAO8 |
| | Amount of thickener (raw material of grease) | mass % | 34.6 | 33.8 | 32.0 | 33.2 | 30.8 | 33.5 |
| Raw material of grease | Average particle diameter | μm | 0.26 | 0.36 | — | 0.26 | 0.50 | — |
| Grease | Mixing consistency (60 W) | — | 285 | 275 | 258 | 251 | 265 | 246 |
| | Oil separation (100° C., 24 hr) | mass % | 0.40 | 0.50 | — | 0.00 | 2.40 | — |
| | Wear mark area | $mm^2$ | 0.11 | 0.12 | 0.16 | 0.17 | 0.22 | 0.42 |

As shown in Table 4, it has become clear that grease having good oil retention and ensured good wear resistance, according to the invention of the present disclosure.

In particular, it has become clear that when a trimellitic acid ester is used as a base oil and PAO is used as a lubricating oil coexisting during synthesis, wear resistance is excellent.

REFERENCE SIGNS LIST

1 dual pinion electric power steering device
2 steering shaft
3 steering gear device
33 housing
31 rack shaft
310 first rack tooth portion
311 first rack teeth
312 cylindrical surface
313 cylindrical surface
314 second rack tooth portion
315 second rack teeth
32 first pinion shaft
320 first pinion tooth portion
321 first pinion teeth
392 first sheet member
54 second pinion shaft
540 second pinion tooth portion
541 second pinion teeth
592 second sheet member
601 column type electric power steering device
602 steering shaft
603 steering gear device
633 housing
631 rack shaft
710 rack tooth portion
711 rack teeth
712 cylindrical surface
632 pinion shaft
720 pinion tooth portion
721 pinion teeth
792 sheet member
801 ball bearing
802 inner ring
803 outer ring
804 ball
805 cage
806 seal
G grease

The invention claimed is:

1. A method for producing a raw material of grease, comprising:

preparing a first thickener raw material;

a second thickener raw material;

a first lubricating oil;

a second lubricating oil;

a first solvent that has a boiling point lower than those of the first lubricating oil and the second lubricating oil, dissolves the first lubricating oil, and does not dissolve a produced thickener; and a second solvent that has a boiling point lower than those of the first lubricating oil and the second lubricating oil, dissolves the second lubricating oil, and does not dissolve the produced thickener;

dissolving the first lubricating oil in the first solvent, and dissolving or dispersing the first thickener raw material in the first solvent to obtain a first mixed solution;

dissolving the second lubricating oil in the second solvent, and dissolving or dispersing the second thickener raw material in the second solvent to obtain a second mixed solution; and mixing the first mixed solution and the second mixed solution, and reacting the first thickener raw material and the second thickener raw material to produce a thickener, removing the first solvent from the first mixed solution to which the first lubricating oil has been added; and pulverizing the first mixed solution from which the first solvent has been removed to obtain a raw material of grease being a thickener powder containing, a thickener and the first lubricating oil.

2. The method for producing a raw material of grease according to claim 1, wherein at least one of the first lubricating oil and the second lubricating oil is poly-α-olefin.

3. A method for producing a raw material of grease, comprising:

preparing a first thickener raw material;

a second thickener raw material;

a first lubricating oil;

a first solvent that has a boiling point lower than that of the first lubricating oil, dissolves the first lubricating oil, and does not dissolve a produced thickener; and a second solvent that has a boiling point lower than that of the first lubricating oil and does not dissolve a produced thickener;

dissolving the first lubricating oil in the first solvent, and dissolving or dispersing the first thickener raw material in the first solvent to obtain a first mixed solution;

dissolving or dispersing the second thickener raw material in the second solvent to obtain a second mixed solution; and mixing the first mixed solution and the second mixed solution, and reacting the first thickener raw material and the second thickener raw material to produce a thickener, removing the first solvent from the first mixed solution to which the first lubricating oil has been added; and pulverizing the first mixed solution from which the first solvent has been removed to obtain a raw material of grease being a thickener powder containing, a thickener and the first lubricating oil.

4. The method for producing a raw material of grease according to claim 3, wherein the first lubricating oil is poly-α-olefin.

5. A method for producing a raw material of grease, comprising:

preparing a first thickener raw material;

a second thickener raw material;

a first lubricating oil;

a first solvent that has a boiling point lower than that of the first lubricating oil, and does not dissolve a produced thickener; and a second solvent that has a boiling point lower than that of the first lubricating oil and does not dissolve a produced thickener;

dissolving or dispersing the first thickener raw material in the first solvent to obtain a first mixed solution;

dissolving or dispersing the second thickener raw material in the second solvent to obtain a second mixed solution; and mixing the first mixed solution, the second mixed solution, and the first lubricating oil, and reacting the first thickener raw material and the second thickener raw material to produce a thickener, removing the first solvent from the first mixed solution to which the first lubricating oil has been added; and pulverizing the first mixed solution from which the first solvent has been removed to obtain a raw material of grease being a thickener powder containing, a thickener and the first lubricating oil.

6. The method for producing a raw material of grease according to claim 5, wherein the first lubricating oil is poly-α-olefin.

7. A method for producing a raw material of grease comprising:

preparing a synthesized thickener;

a first lubricating oil; and a first solvent that has a boiling point lower than that of the first lubricating oil, dissolves the first lubricating oil, and does not dissolve the thickener; and dissolving the first lubricating oil in the first solvent to obtain a first solution, and impregnating the thickener with the obtained first solution, removing the first solvent from the thickener impregnated with the first solution; and pulverizing the thickener from which the first solvent has been removed, to obtain a raw material of grease being a thickener powder containing, a thickener and the first lubricating oil.

8. A method for producing a raw material of grease comprising:

preparing a thickener;

a first lubricating oil; and a first solvent that has a boiling point lower than that of the first lubricating oil, dissolves the first lubricating oil, and does not dissolve the thickener; and dispersing the thickener in the first solvent to obtain a first mixed solution, and adding the first lubricating oil to the obtained first mixed solution, removing the first solvent from the thickener impregnated with the first solution; and pulverizing the thickener from which the first solvent has been removed, to obtain a raw material of grease being a thickener powder containing, a thickener and the first lubricating oil.

* * * * *